US006125583A

United States Patent [19]

Murray et al.

[11] Patent Number: 6,125,583

[45] Date of Patent: Oct. 3, 2000

[54] POWER SLIDING MINI-VAN DOOR

[75] Inventors: Shawn Murray; Thomas P. Frommer; Andrew R. Daniels, all of Ontario, Canada

[73] Assignee: Atoma International Inc., Newmarket, Canada

[21] Appl. No.: 09/132,906

[22] Filed: Aug. 12, 1998

Related U.S. Application Data

[60] Provisional application No. 60/055,296, Aug. 13, 1997.

[51] Int. Cl.[7] ..... B61L 29/08

[52] U.S. Cl. ..... 49/291; 49/360

[58] Field of Search ..... 49/360, 280, 291

[56] References Cited

U.S. PATENT DOCUMENTS

| | | | |
|---|---|---|---|
| 3,022,108 | 2/1962 | Cooley | 49/358 |
| 3,124,344 | 3/1964 | Mano | 49/300 |
| 3,398,484 | 8/1968 | Katsumura et al. | 49/358 |
| 3,479,767 | 11/1969 | Gardner et al. | 49/300 |
| 4,263,995 | 4/1981 | Wahlstedt | 192/35 |
| 4,429,265 | 1/1984 | Barnard | 318/475 |
| 4,560,185 | 12/1985 | Moriya et al. | 49/300 |
| 4,612,729 | 9/1986 | Sato | 49/358 |
| 4,848,031 | 7/1989 | Yamagishi et al. | 49/358 |
| 4,862,640 | 9/1989 | Boyko et al. | 49/213 |
| 4,887,390 | 12/1989 | Boyko et al. | 49/214 |
| 4,984,385 | 1/1991 | DeLand | 49/280 |
| 5,004,280 | 4/1991 | Schap | 292/341.16 |
| 5,018,303 | 5/1991 | Koura et al. | 49/280 |
| 5,025,591 | 6/1991 | DeLand et al. | 49/360 |
| 5,046,283 | 9/1991 | Compeau et al. | 49/138 |
| 5,062,241 | 11/1991 | DeLand | 49/460 |
| 5,063,710 | 11/1991 | Schap | 49/280 |
| 5,069,000 | 12/1991 | Zuckerman | 49/28 |
| 5,076,016 | 12/1991 | Adams et al. | 49/360 |
| 5,083,472 | 1/1992 | Kang | 74/89.21 |
| 5,105,131 | 4/1992 | Schap | 318/282 |
| 5,140,316 | 8/1992 | DeLand et al. | 340/825.69 |
| 5,144,769 | 9/1992 | Koura | 49/360 |
| 5,168,666 | 12/1992 | Koura et al. | 49/360 |
| 5,189,839 | 3/1993 | DeLand et al. | 49/360 |
| 5,203,112 | 4/1993 | Yamagishi et al. | 49/280 |
| 5,216,838 | 6/1993 | DeLand et al. | 49/280 |
| 5,239,779 | 8/1993 | DeLand et al. | 49/360 |
| 5,263,762 | 11/1993 | Long et al. | 296/146.4 |
| 5,355,624 | 10/1994 | Bacon | 49/280 |
| 5,389,920 | 2/1995 | DeLand et al. | 340/825.69 |
| 5,434,487 | 7/1995 | Long et al. | 318/286 |
| 5,536,061 | 7/1996 | Moore et al. | 296/155 |
| 5,537,782 | 7/1996 | Klippert et al. | 49/358 |
| 5,632,120 | 5/1997 | Shigematsu et al. | 49/280 |
| 5,644,869 | 7/1997 | Buchanan, Jr. | 49/362 |
| 5,737,876 | 4/1998 | Dowling | 49/360 |

FOREIGN PATENT DOCUMENTS

| | | |
|---|---|---|
| 0 122556 A2 | 10/1984 | European Pat. Off. . |
| 0 640740 A1 | 3/1995 | European Pat. Off. . |
| 2 731741 A1 | 9/1996 | France . |

*Primary Examiner*—Daniel P. Stodola
*Assistant Examiner*—Curtis A. Cohen
*Attorney, Agent, or Firm*—Pillsbury Madison & Sutro LLP

[57] ABSTRACT

A power sliding door for a motor vehicle comprises a door structure, a power drive assembly, a latch assembly, and a single motor for operating both the latch assembly and the power drive assembly. The door structure is mounted on a track associated with the motor vehicle, the door structure being movable along the track between opened and closed positions. The power drive assembly is connected with the door and capable of being driven to move the door along the track between the opened and closed positions. The latch assembly is mounted on the door and movable between latched and unlatched positions. The single motor is mounted on the door structure operatively connected with both the power drive assembly and the latch assembly. The motor drives the power drive assembly and thus enables the power drive assembly to move the door along the track between the opened and closed positions. The motor assists movement of the latch assembly to the latched position after the power drive assembly moves the door to the closed position.

18 Claims, 23 Drawing Sheets

POWER SLIDING MINI-VAN DOOR

CROSS REFERENCES TO RELATED APPLICATIONS

This application claims priority of U.S. Provisional Application 60/055,296, filed on Aug. 13, 1997, the contents of which are hereby incorporated by reference.

BACKGROUND OF THE INVENTION

1. Field of the Invention

The present invention is related to a power sliding mini-van door, and in particular, to a motor which can be used to drive both a power drive assembly and a lock cinching assembly of the door.

2. Background of the Related Art

Conventional systems for automatically opening and closing a sliding door in a vehicle include a power drive assembly for moving the door and a latch assembly for cinching the door so that the door can be moved into a fully locked position. A first motor drives the power drive assembly and a second motor drives the latch assembly. The use of these multiple motors leads to a number of difficulties. For example, the use of the multiple motors increases the cost of the system and further necessitates additional corresponding circuitry to be added to the system, thereby further increasing costs. Moreover, the increase in components as a result of using multiple motors results in an undesirable increase in the weight of the door.

When the door of the vehicle is being opened or closed, it will often encounter an obstacle which will resist or hinder the door's movement. This obstacle can be, for example, a user of the vehicle. Thus, it is desirable for a system which automatically opens or closes the door to be able to reverse direction upon the detection of the obstacle. Unfortunately, these detection systems can fail, sometimes without previous notification of its defective state being provided to the vehicle's users. Accordingly, it would be desirable to have at least two systems to detect obstacles of the door's movement in case one of the systems fails.

In conventional systems, changes in motor speed are a direct function of the effective voltage of an input signal. When the opening or closing of the door is initiated, the rapidly changing input signal causes an in-rush current. This in-rush current is known to demagnetize motor magnets, which reduces horsepower and is detrimental to the life of any motor. Thus, it would be desirable to reduce or eliminate the in-rush current.

SUMMARY OF THE INVENTION

It is therefore an object of the present invention to use a single motor to drive both the power drive assembly and a latch assembly of a vehicle door. This will decrease the number of required parts and hence, simplify and lower the cost of manufacture, while reducing the weight of the door.

This object is achieved by providing power sliding door for a motor vehicle that comprises a door structure, a power drive assembly, a latch assembly, and a single motor for operating both the latch assembly and the power drive assembly. The door structure is mounted on a track associated with the motor vehicle, the door structure being movable along the track between opened and closed positions. The power drive assembly is connected with the door and capable of being driven to move the door along the track between the opened and closed positions. The latch assembly is mounted on the door and movable between latched and unlatched positions. The single motor is mounted on the door structure operatively connected with both the power drive assembly and the latch assembly. The motor drives the power drive assembly and thus enables the power drive assembly to move the door along the track between the opened and closed positions. The motor assists movement of the latch assembly to the latched position after the power drive assembly moves the door to the closed position.

It is another object of the present invention to provide two systems for detecting an obstacle to the door's movement. One of two systems includes at least one Hall effect sensor to measure the speed of the motor. If the detected speed is less than a predetermined threshold, then it is assumed that an obstacle is in the way of the door and hence, the direction of the motor is reversed. The second system of the present invention includes a tape switch mounted on the edge of the door. The tape switch has two electrical strips which will contact each other if the tape switch contacts an obstacle and will provide a signal to reverse the direction of the motor. These two systems operate independently of one another. Therefore, if one of the systems fails, the other would still enable the motor to reverse direction upon detection of an obstacle. Thus, the safety of all users of the vehicle is maintained.

It is another object of the invention to include a controller to provide a signal to the motor which slowly ramps up the effective voltage, and hence the speed of the motor, when the opening or closing of the door is initiated. This will reduce or eliminate the in-rush current caused by a rapid start sequence. Thus, the life and performance of the motor is enhanced.

These and other objects, features and characteristics of the present invention, will be more apparent upon consideration of the detailed description and appended claims with reference to the accompanying drawings.

DETAILED DESCRIPTION OF THE DRAWINGS

Figure 1:
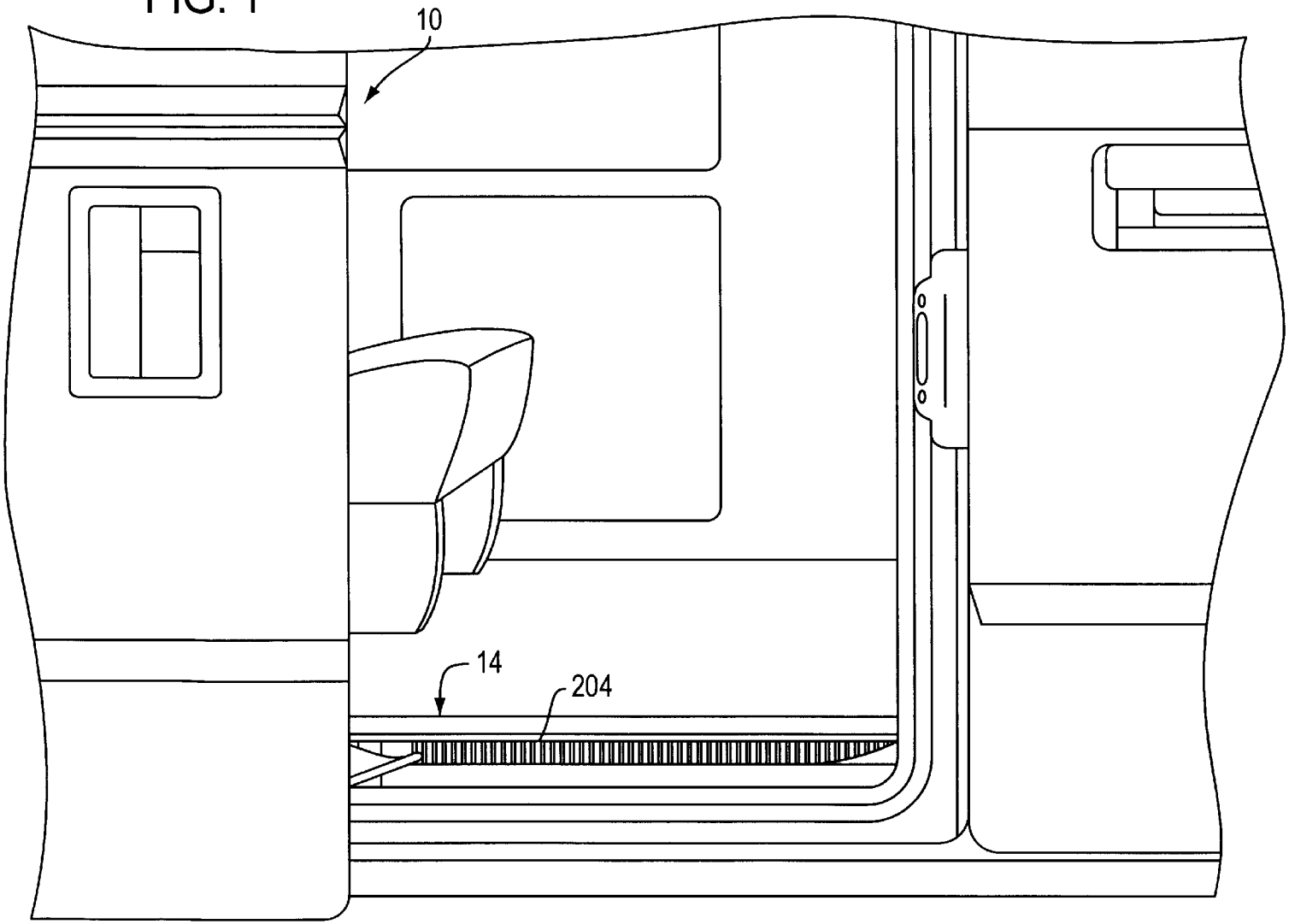
FIG. 1 is a partial exterior elevational view of a mini-van incorporating the power sliding door of the present invention.
Figure 2:
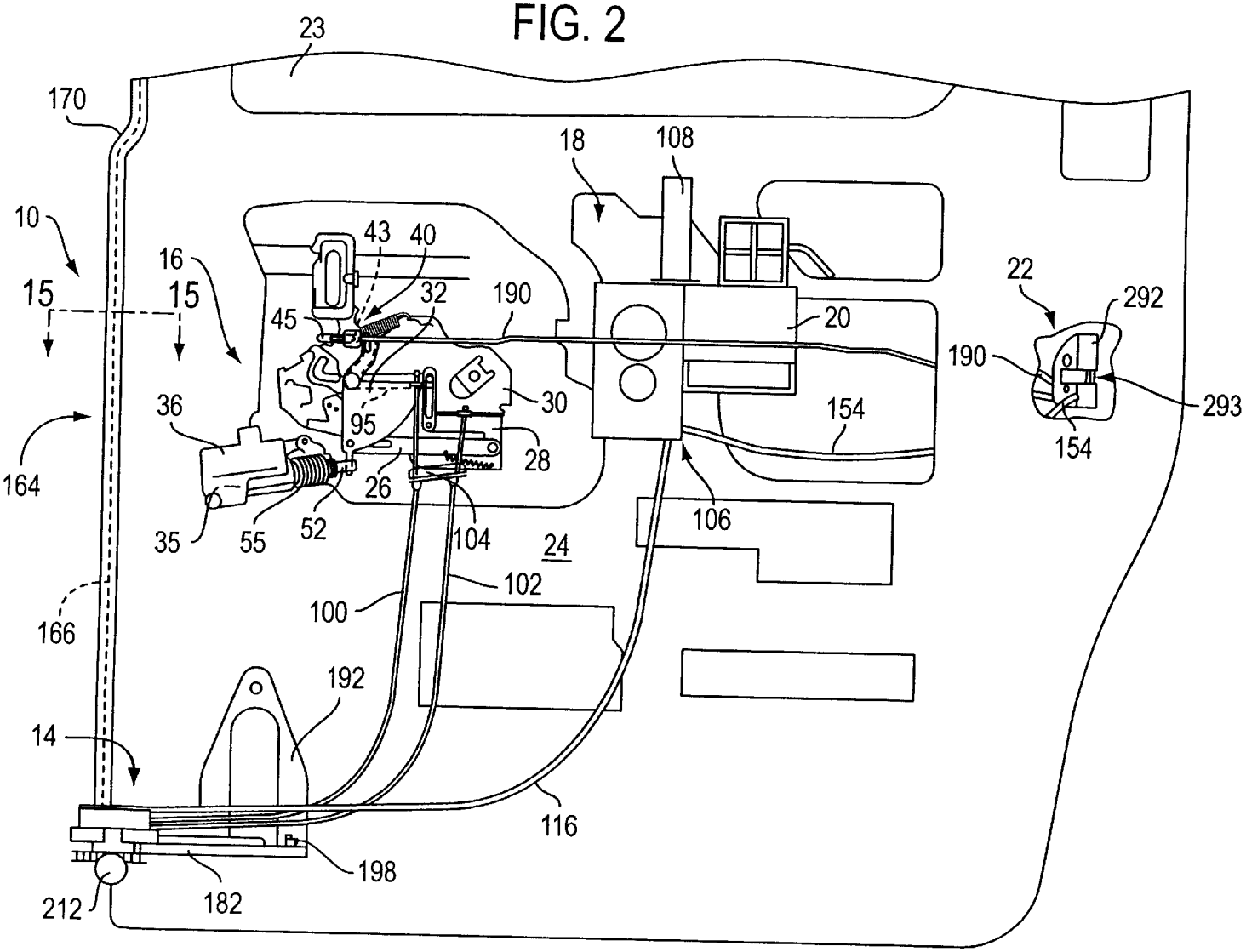
FIG. 2 is a partial inboard elevational view of a passenger side mini-van power sliding door, with the paneling removed, and in accordance with the principles of the present invention.
Figure 3:
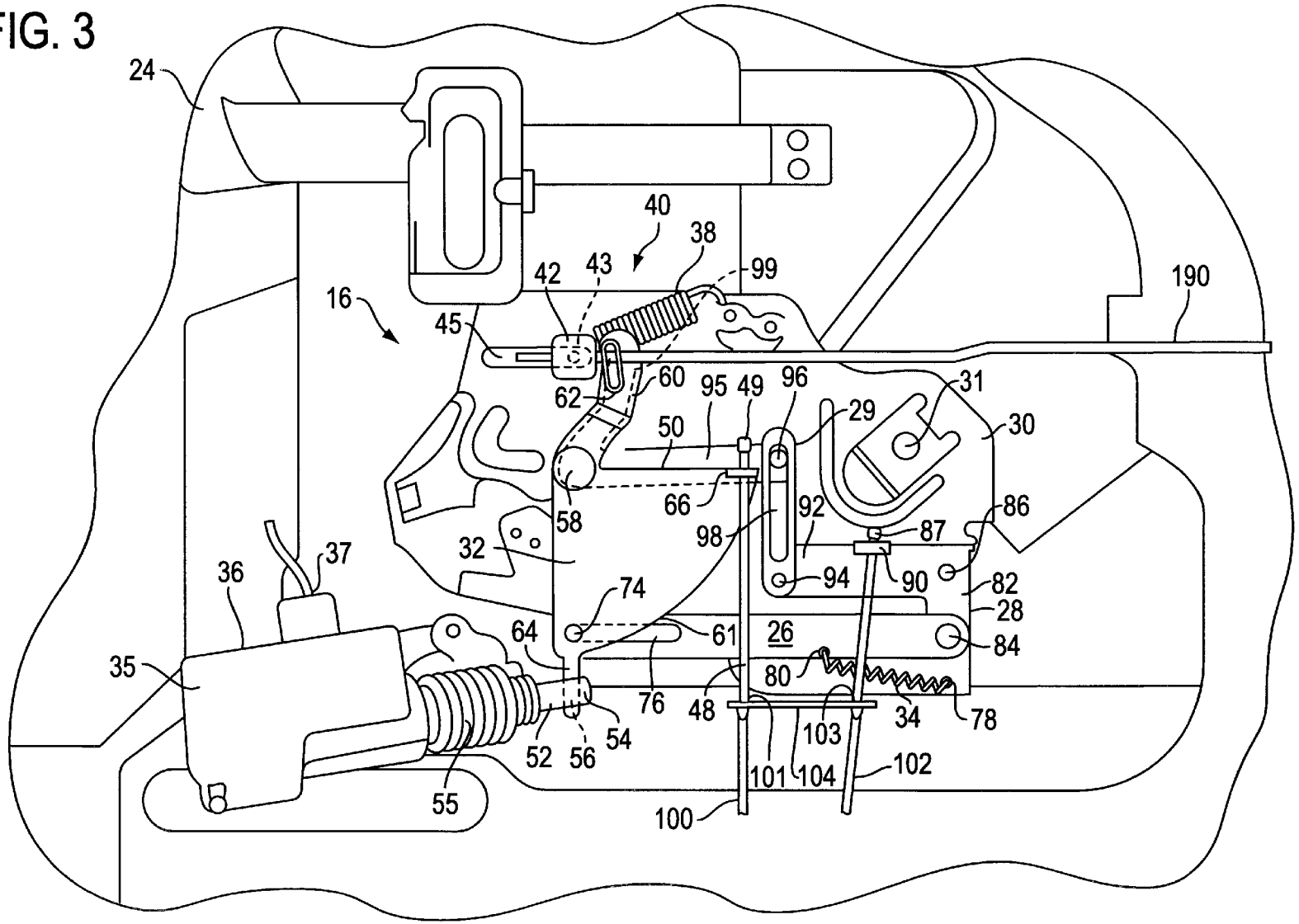
FIG. 3 is an inboard plan view of an actuating brain plate incorporated in the power sliding door of the present invention, with the actuator in a neutral position.

Referring now more particularly to the drawings, there is shown in FIG. 1 a partial exterior elevational view of a mini-van which incorporates a power sliding door, generally indicated at 10, in accordance with the present invention. The door 10 is shown mounted on vehicle track 204. FIG. 2 is a partial inboard elevational view of the passenger side power-sliding mini-van door 10, embodying the principles of the present invention. The mini-van door 10 generally comprises a lower drive assembly 14 cooperable with a track assembly for moving the door between opened and closed positions, a brain plate actuating assembly 16 for door actuation, a motor and gear assembly 18 for automated door opening and closing, a microprocessor 20 for system logic and actuation control, and an electro-mechanically actuated cable controlled latch assembly, generally indicated at 22. The brain plate actuating assembly 16 is mounted below the door window 23 in a recessed section of the door frame 24. The microprocessor 20 is a computer chip programmed to control the logic and sequence of operation. The microprocessor 20 receives feedback information from various electrical components and processes the information through its software providing output signals that operate the system. As shown in FIG. 2, the brain plate actuating assembly 16 includes an electrically operated linear actuator 36 rigidly mounted to the door frame 24, forwardly of a mounting plate 30 (relative to the fore-aft vehicle direction). The linear actuator 36 has an electrically actuated motor 35 that is electrically connected, as at 37, to receive the output signal from microprocessor 20 which is mounted within a motor assembly housing 107 (see FIG. 5). In FIG. 3, the linear actuator 36 is shown in a neutral or central position, as will be described in greater detail later.

A movable cylindrical extension rod 52 is connected to and driven for movement by the electrical motor 35. The extension rod 52 is movable along its longitudinal axis between extended and retracted positions. The extension rod 52 is protected by a flexible accordion sheath 55 that covers the interconnecting area between the electrical motor 35 and the extension rod 52, thereby protecting the linear actuator 36 from dirt or debris. The distal end of the extension rod 52 has a centrally located aperture 56 extending vertically therethrough.

The brain plate actuating assembly 16 also comprises a linkage assembly, shown at 50, for operatively connecting the actuator 36 with the lower drive assembly 14 and latch assembly 22. The linkage assembly 50 includes a generally flat triangular or sector shaped actuating plate 32, which is pivotally attached by pivot pin 58 to the mounting plate 30. An arcuate outer edge 61 defines the size and general shape of the actuating plate 32. At the upper pivotal corner is a longitudinal protrusion 60 extending upwardly. A small oval shaped bumper 62 is attached to the upper end of the longitudinal protrusion 60 and extends laterally outwardly therefrom.

A tab 64 extends downwardly from the lower corner of the actuating plate 32. The tab 64 extends through the aforementioned aperture 56 in the rod 52 of the linear actuator 36. The tab 64 coacts with linear actuator 36 to pivot the actuating plate 32 in the desired direction. At the opposite upper corner of actuating plate 32 is a cable engaging end bracket 66. A lower assembly engaging cable 48 has a ball end 49 constructed and arranged to engage bracket 66.

The brain plate assembly 16 also mounts one end of a door unlatching rod assembly 40. More particularly, rod assembly 40 comprises a rod member 190 and a rod clamp 42 that also functions as a rod lever. More particularly, the rod clamp 42 is fixed to rod member 190, and has a pin 43 which is received in a slot 45 in the mounting plate 30. When the rod clamp 42 is moved to the left in the figures, it carries with it the end of latch rod 190, as pin 43 rides within slot 45. The opposite end of latch rod 190 extends to the latch assembly 22, as will be described in greater detail later. A rod spring 38 is connected between the mounting plate 30 and the rod clamp 42, biasing the rod clamp 42 and the latch rod 190 towards the right or a stand-by position in FIGS. 3–5.

Fixed to the actuating plate 32, directly above tab 64, is a cylindrical guide pin 74 which extends inwardly toward the door frame 24. The guide pin 74 passes through a longitudinal slot 76, in the forward end of an elongate connecting link 26. The opposite or rearward end of connecting link 26 is pivotally connected to an L-shaped pivot link 28 by a connecting pin 84.

A connecting spring 34 is attached between the mounting plate 30 at an aperture 78 and the lower side of the connecting link 26 at an aperture 80 in a mid-portion thereof. The spring 34 is tensioned slightly, thereby biasing the connecting link 26 downwardly in a stand-by condition.

The L-shaped pivot link 28 is pivotally mounted at a corner between a short leg portion 82 and a stem 92 thereof to the mounting plate 30 by a pivot pin 86. The ball end 87 of a disengaging cable 88 is received and held in place by a bracket 90, which extends laterally from the top edge of the stem 92 of the L-shaped pivot link 28. With the stem 92 of the pivot link 28 held the stand-by condition in FIG. 3, a slight amount of slack is provided for the disengage cable 88. The distal end of stem 92 of the pivot link 28 is pivotally attached to a slotted, lost motion link member 29 by a hinge pin 94.

The lost motion link member 29 connects the L-shaped link 28 with a second linkage arm 95 disposed in parallel and adjacent relation with actuating plate 32 (i.e., behind plate 32 in FIGS. 3–5), and is mounted for common pivotal movement around the pivot pin 58. The linkage arm 95 is operably connected to both inside and outside manual door handles (not shown), and has a laterally extending pin 96 received within a longitudinal slot 98 in the link member 29. The linkage arm 95 further includes an elongate extension 99 similar to extension 60 of first actuating plate 32, and similarly has a bumper (not shown) that is adapted to engage the rod/clamp 42 of the rod assembly 40.

Cable sheaths 100 and 102 are fixedly attached to bracket 104, which is fixed to mounting plate 30. Engage cable 48 passes through an opening 101 in the bracket 104 and disengage cable 88 passing through opening 108 in the bracket.

When the inside or outside handle is manually moved to unlatch the door, the linkage arm 95 is pivoted in an unlatching sense (in a counterclockwise direction in the figures) so that the extension 99 moves the rod clamp 42 to the left against the bias of spring 38. As a result, the latch rod 190 is moved to the left to unlatch door latch assembly 22. In addition, such pivotal movement of the linkage arm 95 causes the pin 96 to ride upward within slot 98 until the link member 29 is moved upwards to cause the L-shaped link 28 to pivot in a disengaging sense (in a clockwise direction in the figures) around hinge pin 86. Bracket 90 is thus raised to tension disengage cable 88, which is turn disengages the clutch assembly 184 of lower assembly 14, as will be described in conjunction with FIG. 21. In this manner, the door 10 can be manually opened with no resistance from motor 108, as will also be described.

During this manual mode of operation, the aforementioned pivotal movement of L-shaped link 28 has no effect on actuating plate 32 or actuator 36, as link 26 simply slides relative thereto (e.g., in FIG. 3), with the actuator and actuating plate 32 remaining in the neutral position.

Figure 4:
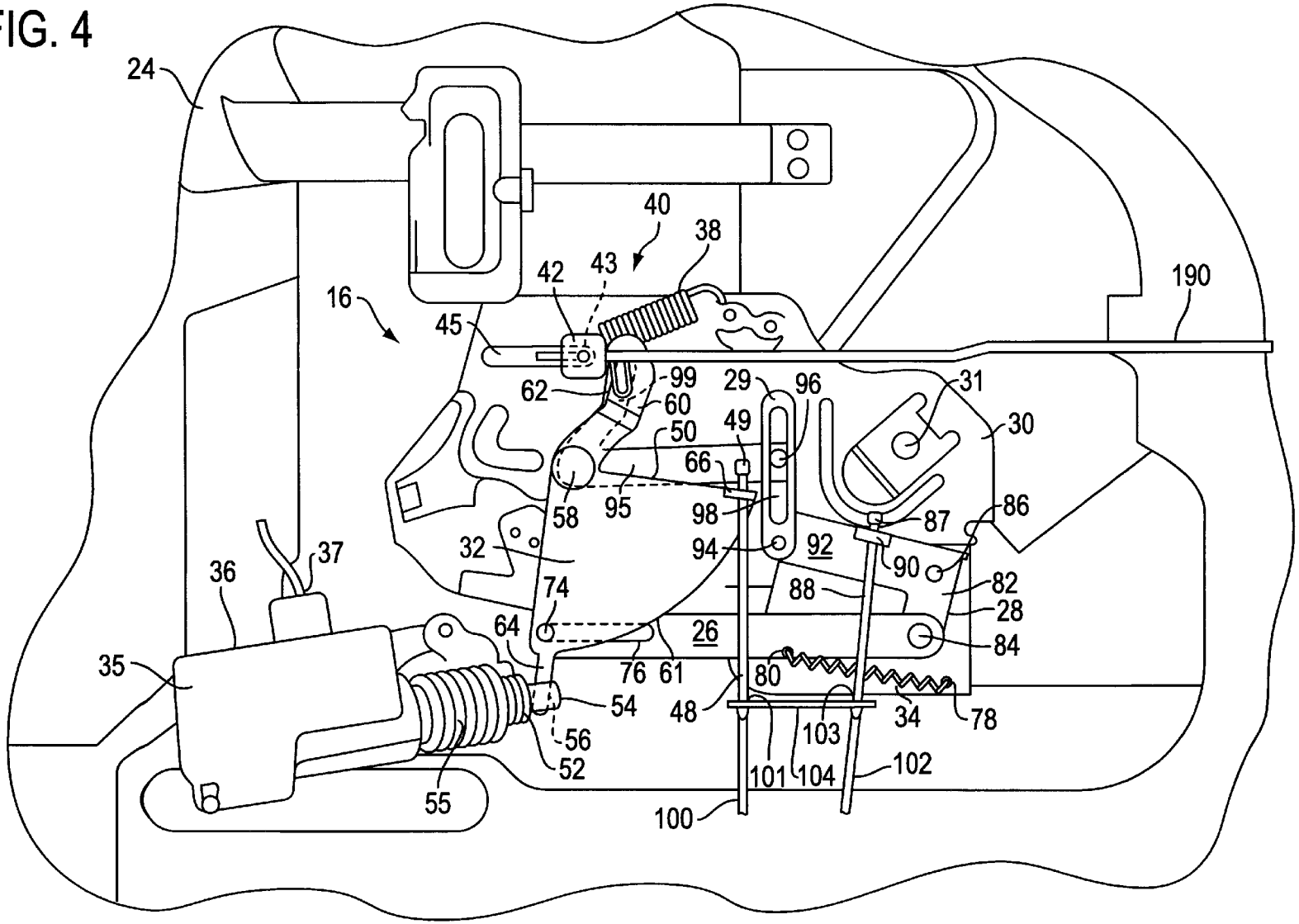
FIG. 4 is an inboard plan view of the actuating brain plate shown in FIG. 3, with the actuator retracted and a lower assembly disengage cable tensioned.

To automatically disengage the clutch 184 of lower assembly 14 without unlocking latch assembly 22 (e.g., during the cinching mode for latch assembly 22, as will be described), the microprocessor 20 electrically signals the linear actuator 36 to retract, as shown in FIG. 4. The actuating plate 32 is pivoted from the neutral position in the clockwise direction or disengaging sense and releases any tension from the engage cable 48. The guide pin 74 of the actuating plate 32 pulls the connecting link 26, which in turn pulls the short leg 82 of the L-shaped pivot link 28 and pivots the L-shaped pivot link 28 clockwise about the pivot pin 86. The stem 92 of the pivot link 28 pivots upwardly so that bracket 90 tensions the disengage cable 88. In this mode of operation, the latch rod 190 is not activated. In addition, the lost motion connection between link 29 and actuating plate 32 via pin 96 and slot 98 prevents the outside or inside door handles (which are functionally connected via pin 96) from being moved in the door unlocking direction.

Figure 5:
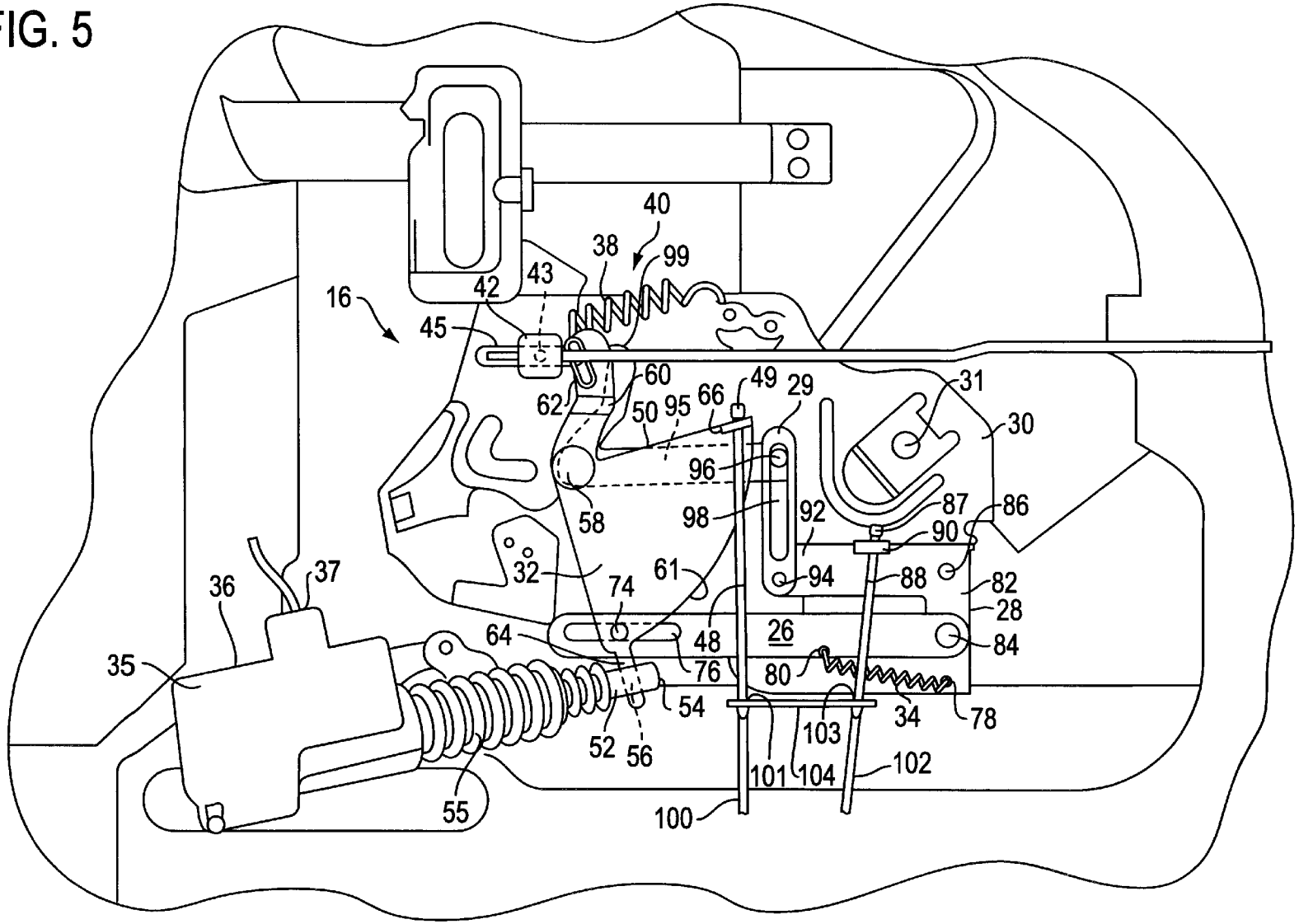
FIG. 5 is an inboard plan view of the actuating brain plate shown in FIG. 3, with the actuator extended, and a lower assembly engage cable tensioned.

To effect automatic opening of the door 10, the microprocessor 20 electrically signals the linear actuator 36 to extend rod 52, as shown in FIG. 5. Movement of tab 64 to the right causes actuating plate 32 to pivot counterclockwise in an engaging sense. The connecting spring 34 prevents a significant amount of pivotal movement of L-shaped pivot link 28 to avoid tensioning of disengage cable 88. By extending rod 52, the actuator 36, pivots the actuating plate 32 thereby moving the cable bracket 66 upward, applying tension to the engage cable 48. The elongated portion 60 pivots with actuating plate 32 and moves bumper 62 into engagement with the rod clamp 42. This pulls latch rod 190, thereby unlatching the latch assembly 22.

The motor and gear assembly 18 comprises an electric motor 108 of standard configuration, a latch assembly gear train 110 mounted within a housing 107 fixed to door frame 24, a cable pulley 114, a flexible drive shaft 116 extending from a distal end of a rigid motor shaft 118, and an electromechanical clutch 112 for coupling the cable pulley 114 with the latch assembly gear train 110. The cable pulley 114 controls a cable 154 for cinching latch assembly 22, and the flexible drive shaft 116 is used to drive the power drive assembly 14.

Figure 6:
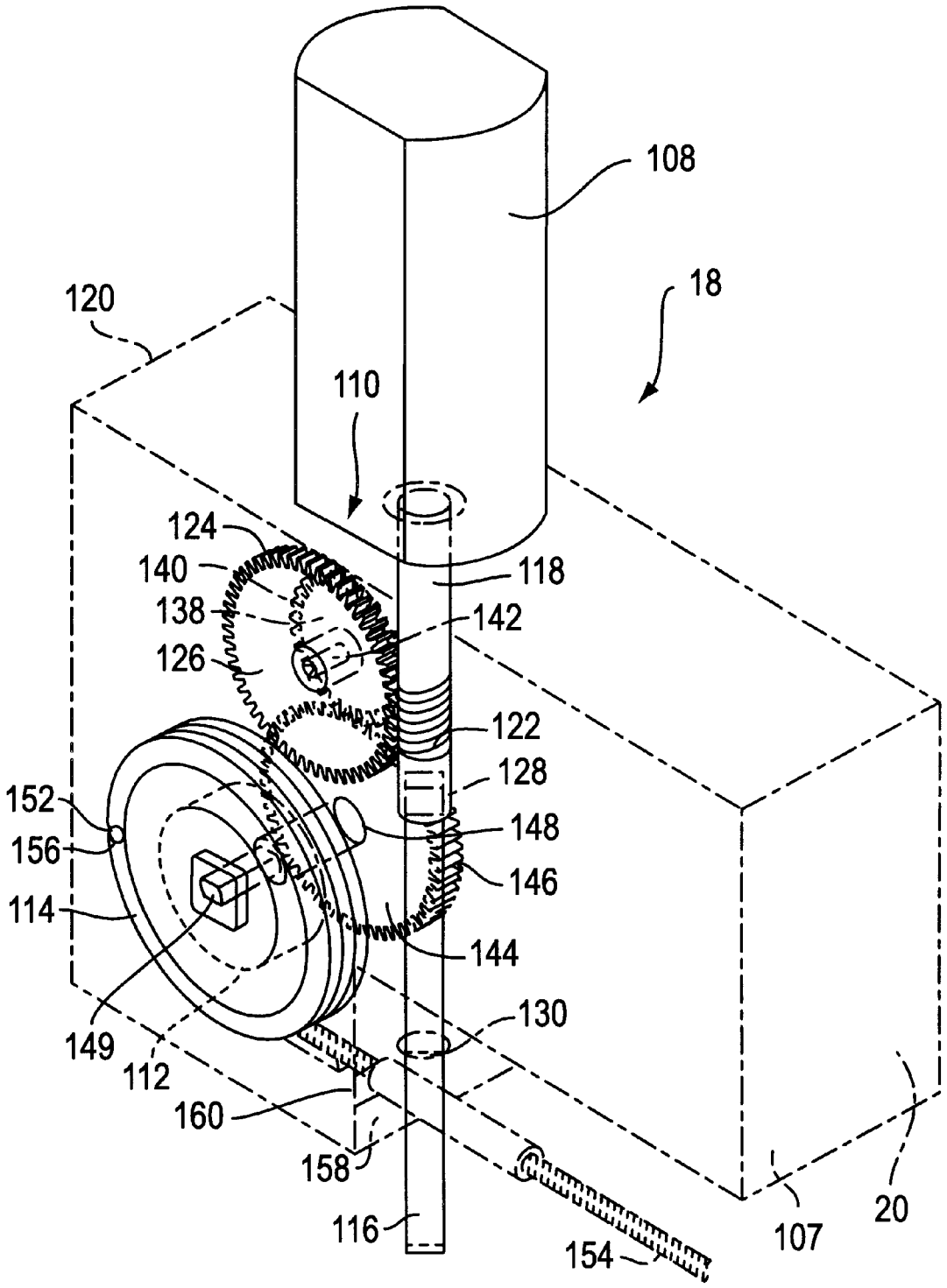
FIG. 6 is an inboard perspective view of a motor drive control assembly incorporated in the power sliding door of the present invention.
Figure 7:
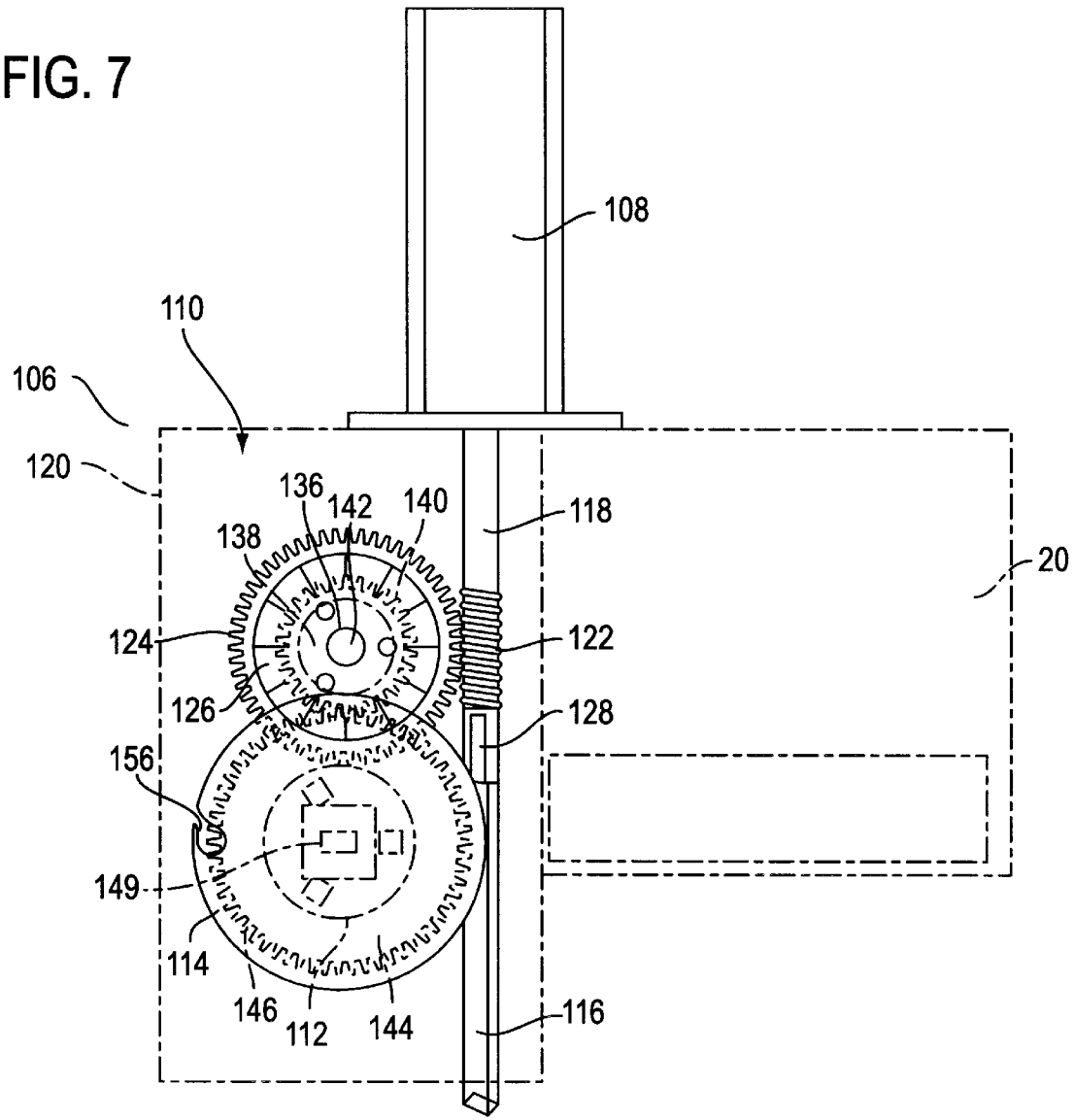
FIG. 7 is a front view of the motor drive control assembly shown in FIG. 6.
Figure 8:
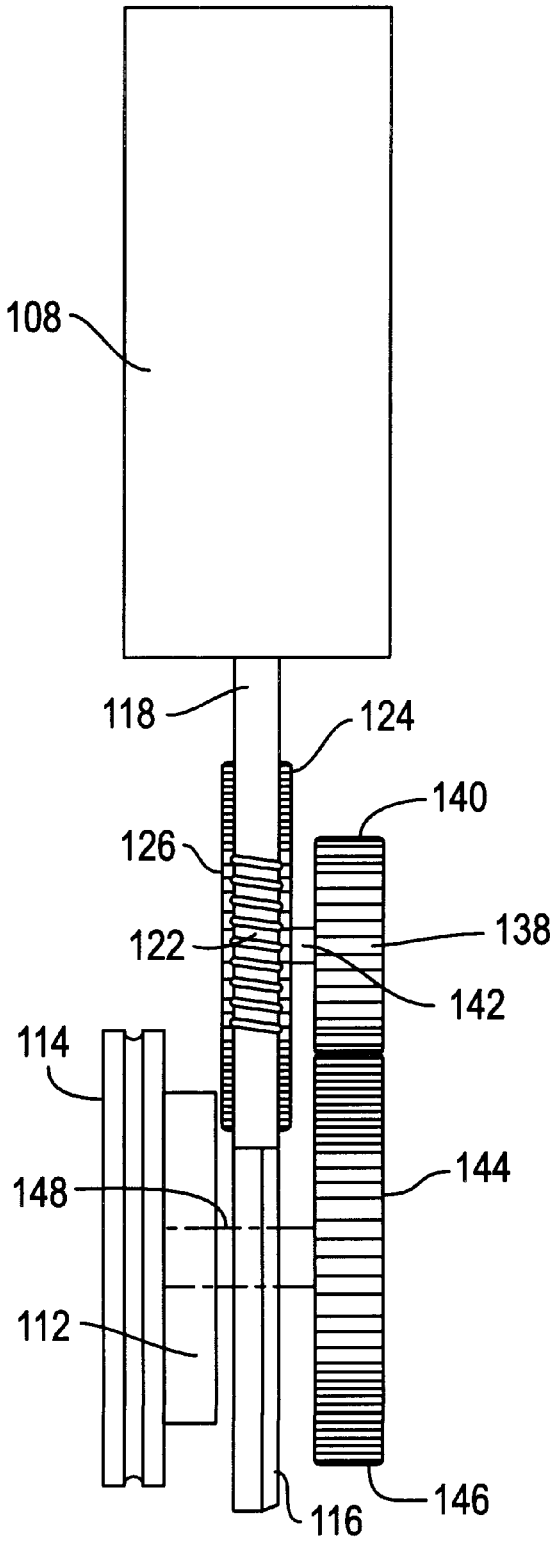
FIG. 8 is a side view of the motor drive control assembly shown in FIG. 6.
Figure 9:
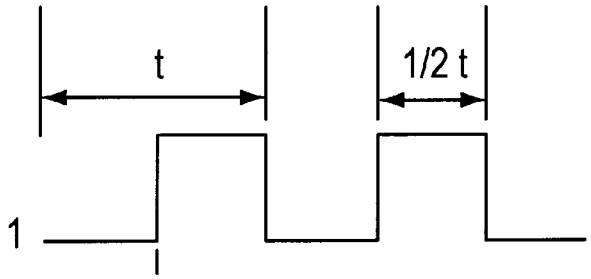
FIGS. 9–13 are graphical representations of the voltage waveforms of the motor drive control assembly, for determining the speed of the motor drive and for detecting the presence of an obstacle in the door travel path.
Figure 10:
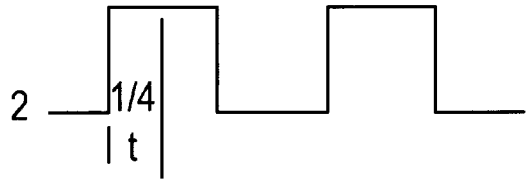
Figure 11:
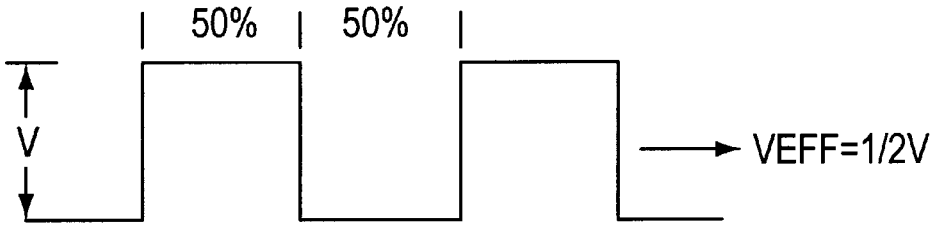

The electric motor 108, as shown in FIG. 6 and 7, is mounted on top of the housing 107. A motor shaft 118 extends from the motor 108 and has screw-like helical threads 122 on the surface thereof forming a wormgear type structure that meshes with teeth 124 of a first gear 126 of latch assembly gear train 110.

The first gear 126 is axially coextensive with and connected for rotation with second gear 138 by any conventional means. The second gear 138 is a solid disc-like structure, smaller in diameter than the first gear 128, and also has teeth 140 extending circumferentially along its outer edge. A mounting shaft 142 passes axially through the first gear 126 and the second gear 138 and connects them for rotation with one another. Mounting shaft 142 is rotatably mounted to the gear housing 107. Third gear 144 is preferably a solid disc that has a diameter larger than both the first gear 126 and the second gear 138, and has teeth 146 extending circumferentially along its outer edge. The teeth 146 of gear 144 mesh with the teeth 140 of the second gear 138. Third gear 144 is axially mounted for rotation on a shaft 148, which is in turn mounted at a first end to the gear housing 107. An intermediate portion of the shaft 148 is fixed to the gear 144 so as to rotate therewith. The second end of shaft 148 is received within the input end of the electromechanical clutch 112. The output end of the electromagnetic clutch is connected with the shaft 149 of a cable pulley 114. During the cinching operation for latch 22, the microprocessor 20 sends a signal to engage the electromechanical clutch 112, so that the gear 144 becomes rotatably coupled to the cable pulley 114 to drive the cable pulley 114 in a clockwise direction or a latching sense. The type of electromechanical clutch 112 contemplated herein is manufactured by Reel Precision Mfg. of Saint Paul, Minn., part # ED30CCW8MM-12, and is disclosed in U.S. Pat. Nos. 4,263,995 and 5,183,437, hereby incorporated by reference. The distal end 128 of motor shaft 118 has an axial opening having a square cross-section adapted to receive one end of the flexible drive shaft 116, which also has a square cross section. The motor shaft 118 is connected to the flex drive shaft 116 so that the motor shaft 118 drivingly rotates the flex driver shaft 116. The flex drive shaft 116 extends downwardly through an aperture 130 in the bottom of the gear housing 107 and continues downwardly to the lower drive assembly 14.

This arrangement in accordance with the present invention allows the same motor 108 to be used for multiple tasks. More specifically, the motor 108 is used for both driving the lock cinching pulley 114 via latch assembly gear train 110 and also for driving the lower drive assembly 14 via flexible drive shaft 116. Both the latch assembly gear train 110 and the flexible drive shaft 116 operate whenever the motor 108 is spinning, either in the forward direction or reverse direction. A clutch 184 on the lower drive assembly 14 (described later in greater detail) can be disengaged to disengage the operative connection between the drive shaft 116 and the gears on lower drive assembly 14 which move the door 10 along track 204. This is done, for example, when the motor 108 is being used to cinch latch 22 via cable pulley 114 into the fully locked or primary latching position. The latch assembly gear train 110, on the other hand, can be disengaged from cable pulley 114 by disengagement of electromechanical clutch 112 when the motor 108 is functioning to drive the lower assembly 14.

As shown in FIG. 6, cinch cable 154 has a ball end 152 thereof positioned within a slot 156 in cable pulley 114 and leads out from the housing 107 through a slot 160. After the electromechanical clutch 112 is magnetically engaged, the motor 108 drives gear train 110 so that cable pulley 114 turns clockwise in a latching sense, and the cinch cable 154 is pulled to cinch the latch assembly 22 into the primary latched position.

Figure 12:
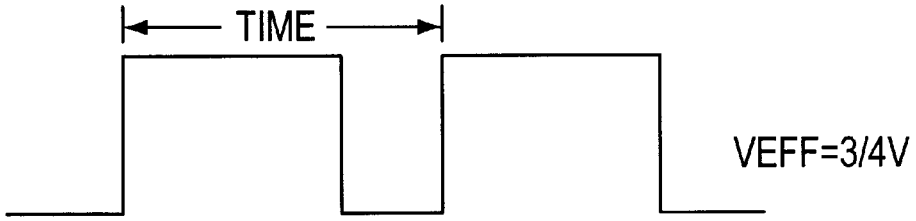
Figure 13:
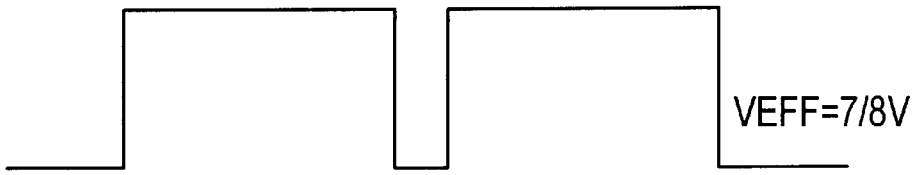
Figure 14:
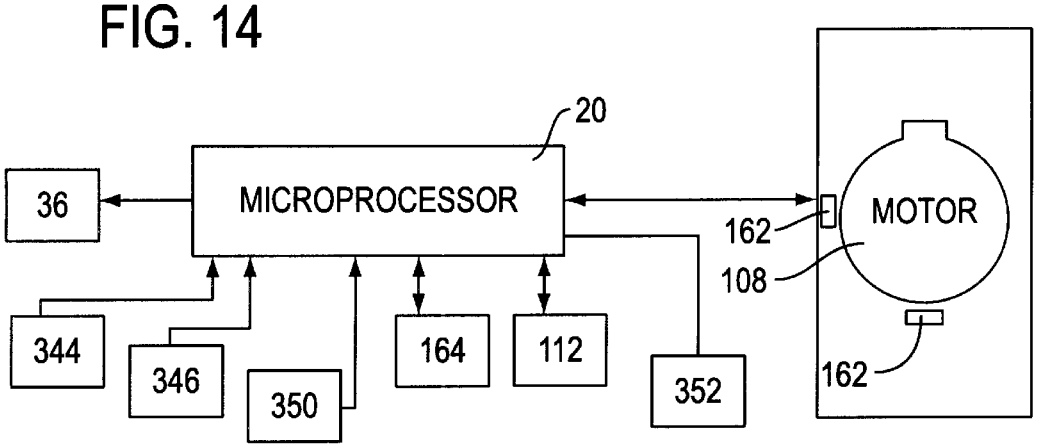
FIG. 14 is a schematic representation of the motor and hall effect sensors used in the obstacle detection arrangement in the power sliding door of the present invention.

Mounted within the motor 108 are two hall effect sensors 162, shown schematically in FIG. 14. The hall effect sensors 162 monitor the rpm of the motor 108 and are set up to provide a quadrature offset for measuring the speed and direction of motor 108 when driving the lower assembly 14. The two hall effect sensors 162 provide on and off (high/low) voltage output signals in response to motor displacement, which are then evaluated and processed by the microprocessor 20. By using a ¼ offset (90° displacement) between the two hall effect sensors 162, two output signals (one from each sensor) enable the motor speed to be monitored with twice the resolution in comparison with a single sensor. Referring to FIGS. 9–13, the frequency of the on/off signals from sensors 162 establish a reference time used to determine motor speed. If only one sensor were used, it would be necessary for ½ t to elapse to determine whether the high or low signal remained high or low for a period of time greater than the ½ t reference period. Because a quadrature system is used in accordance with the invention, it is only necessary to wait ¼ t (e.g., between two high signals of the two sensors) to determine whether the motor is moving more slowly than the threshold speed.

When the motor 108 is detected as moving more slowly than the threshold speed during door closing (i.e., during the motor 108 effecting driving movement of lower assembly 14 via flex drive cable 116), it is assumed by microprocessor 20 that an obstruction is in the way of the door and thus reverses the motor 108 direction to reverse the direction of door movement. This is the primary mode for obstacle detection.

As can be appreciated by those skilled in the art, changes in motor speed are a direct function of the effective voltage ($V_{eff}$). As can be appreciated from FIG. 11, where V effective is ½V, the voltage signal is high for 50% of the time, and low for 50% of the time. As time increases for the high signal portion of the cycle, the effective voltage increases. In accordance with the present invention, when initiating opening or closing of the door 10, it is preferable to have the microprocessor 20 slowly ramp up the effective voltage, and hence the speed of the motor 108 (e.g., to Veffective=¾V as shown in FIG. 12, and then to Veffective=⅞V as shown in FIG. 13) in order to reduce or eliminate in-rush current caused by a rapid start sequence. In-rush current is known to demagnetize motor magnets, which reduces horsepower and is detrimental to the life of any motor.

Figure 15:
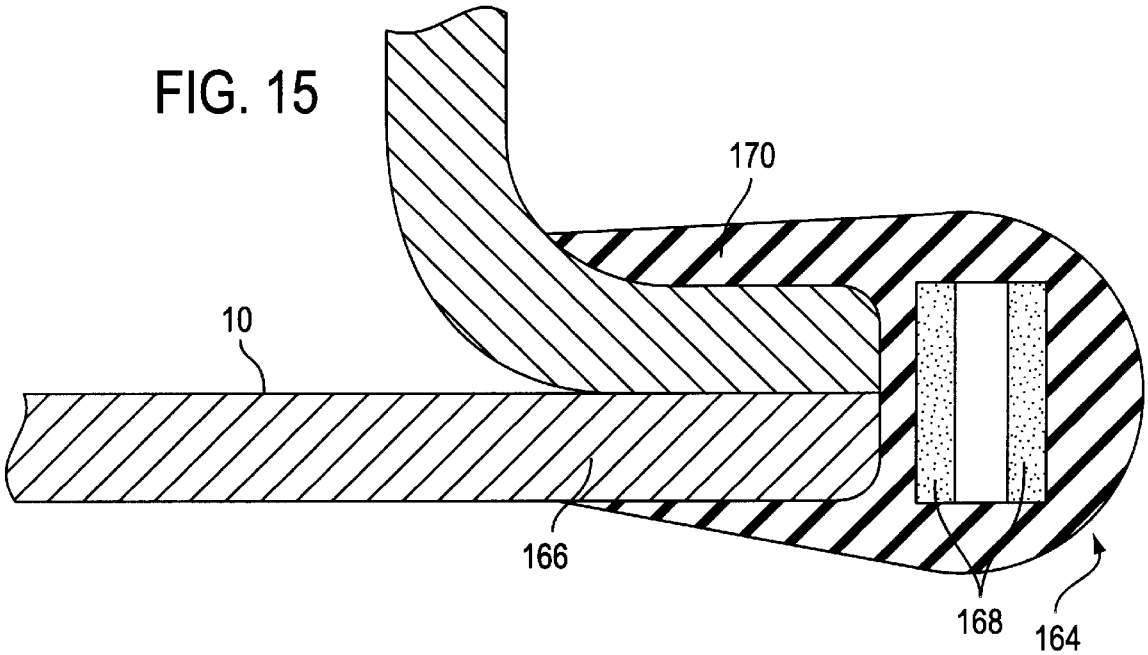
FIG. 15 is a sectional view taken through the line 15—15 in FIG. 2 of a tape sensor used for obstacle detection in the power sliding door of the present invention.
Figure 16:
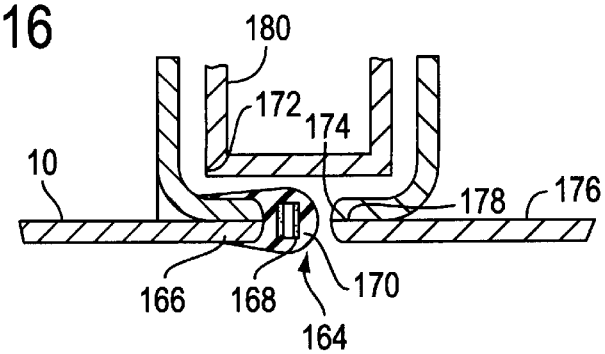
FIG. 16 is a sectional view of the tape sensor of FIG. 15 and illustrating two pinch points for obstacle detection.

FIGS. 15 and 16 is a cross section taken through the line 15—15 in FIG. 2 of an elongate tape switch 164 positioned along the leading edge 166 of the door 10. The tape switch 164 operates as a secondary or back-up mode of obstacle detection in the event of failure of the first mode of detection. The tape switch 164 is preferably of a conventional type, which consists of two metallic tape strips 168 that are mounted in spaced relation within a tubular resilient, rubber housing 170. The strips 168 of tape switch 164 are electrically connected to the microprocessor 20. If the two tape strips 168 come in contact with one another during door movement towards the closed position within the vehicle frame, as when an obstacle is encountered, the microprocessor 20 senses that an object is interfering with door travel and sends a signal to the motor 108 to stop the door 10 from further movement in the forward direction and causes motor 108 to reverse direction and move the door rearwardly to the opened position.

It can be appreciated from FIG. 16 that with the tape switch 164 attached to the door's leading edge 166, two spaced pinch points 172 and 174 can be readily detected. More specifically, as the door 10 approaches the closed position, any obstacle located at two separate pinch points, including a first pinch point between the leading edge 166 of the door 10 and a rear edge or corner 172 of the vehicle's B-pillar 180 and a second pinch point between the leading edge 166 of the door 10 and a rear edge 178 of a front passenger door 176 can be detected. The ability to detect an obstacle at two separate pinch points or at any position during the door's movement toward its closed position is enabled by the fact that the tape switch is mounted on the leading edge of the door 10 rather than on one of the stationary edges 172 or 178. The ability to mount the tape switch on the door 10 is enabled by the fact that the door 10 itself is electrified. Moreover, because the tape switch is mounted on the door itself, rather than one or more of the opposite edges 172 or 178 forming the pinch points, the tape switch is not limited to obstacle detection at such pinch points. Rather, the tape switch will detect any obstacle it encounters at any point in the door's path of movement toward its closed position.

Figure 17:
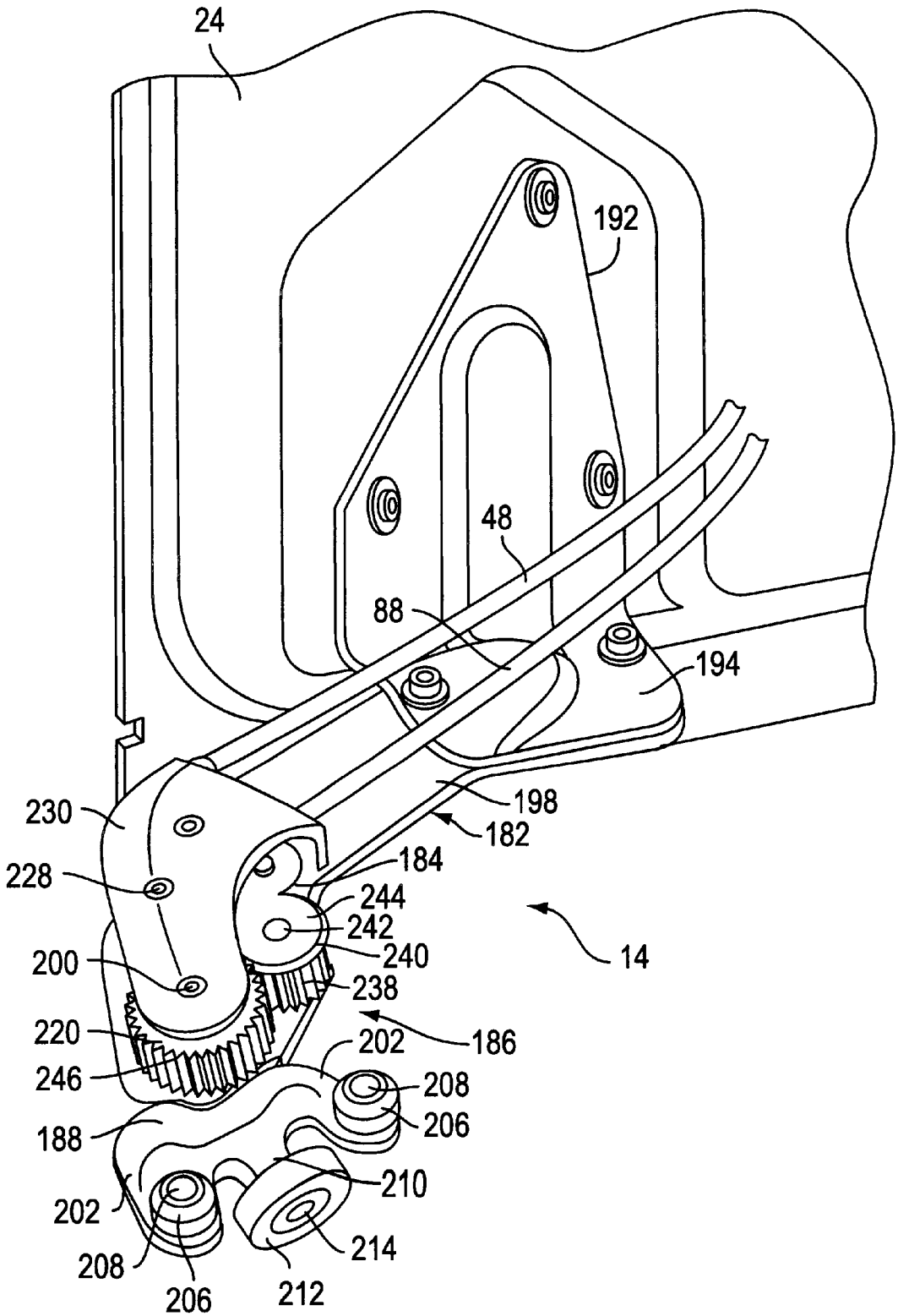
FIG. 17 is a perspective view of the lower drive assembly of the power sliding door of the present invention.

Shown in FIG. 17, is the lower drive assembly 14 which mounts the door 10 on a track rail 204 (see FIG. 18) fixed to the vehicle body. The drive assembly 14 comprises a mounting structure 182, a clutch assembly 184, a gear drive assembly 186, and a track rail guide assembly 188. The mounting structure 182 has an L-shaped mounting bracket 192 mounted on the door frame 24 with any conventional attaching hardware. The bracket 192 has a bottom leg 194 extending outwardly in a perpendicular manner from the door frame 24. The mounting structure 182 further includes an arm portion 198 connected with the bracket 192. The arm portion 198 supports the clutch assembly 184, the gear drive assembly 186 and the track rail guide assembly 188.

Figure 18:
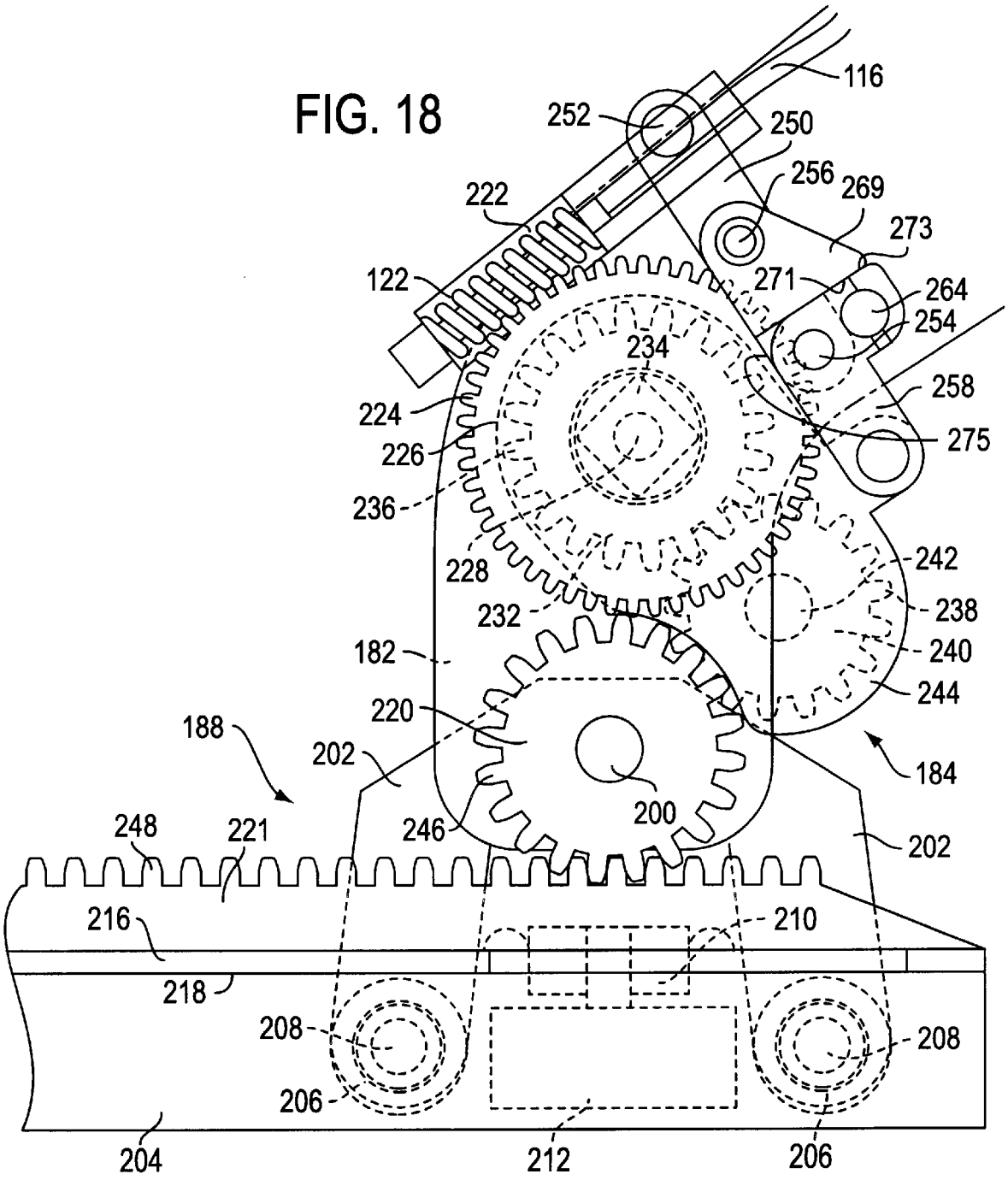
FIG. 18 is a partial plan view of the lower drive assembly of FIG. 17 and positioned at the rear end of the track rail.
Figure 19:
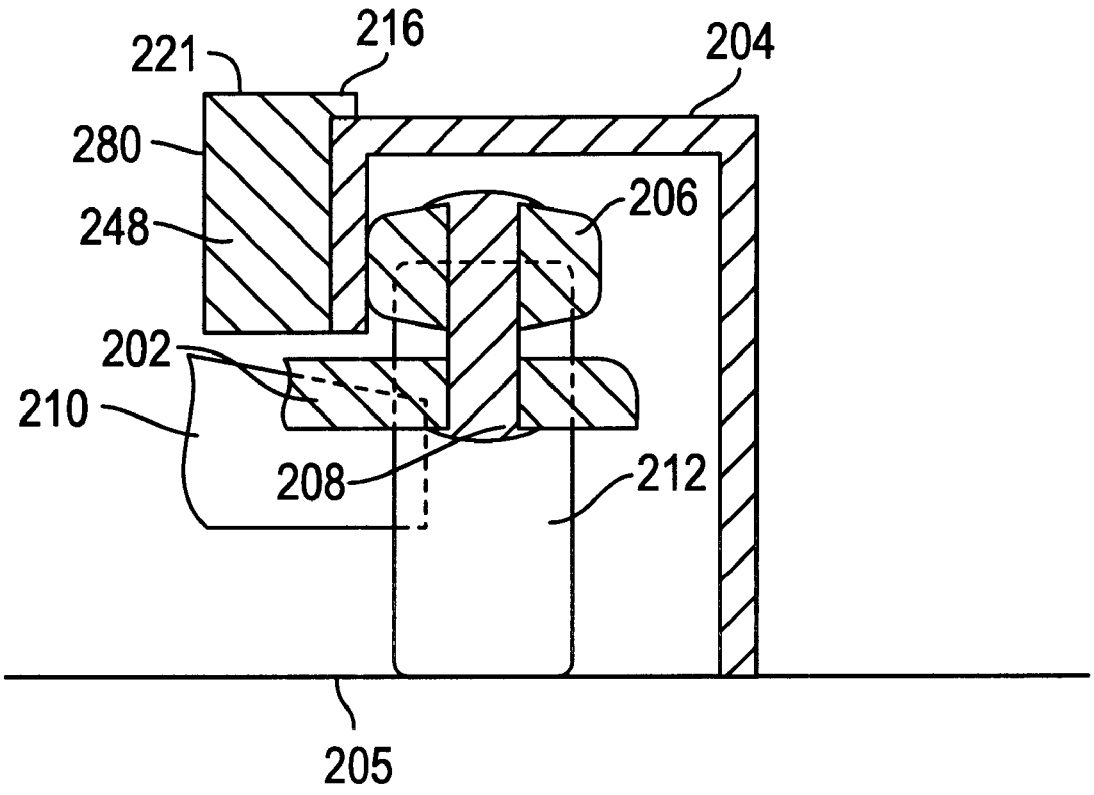
FIG. 19 is a sectional view of the vehicle track assembly to which the door of the present invention is mounted.
Figure 20:
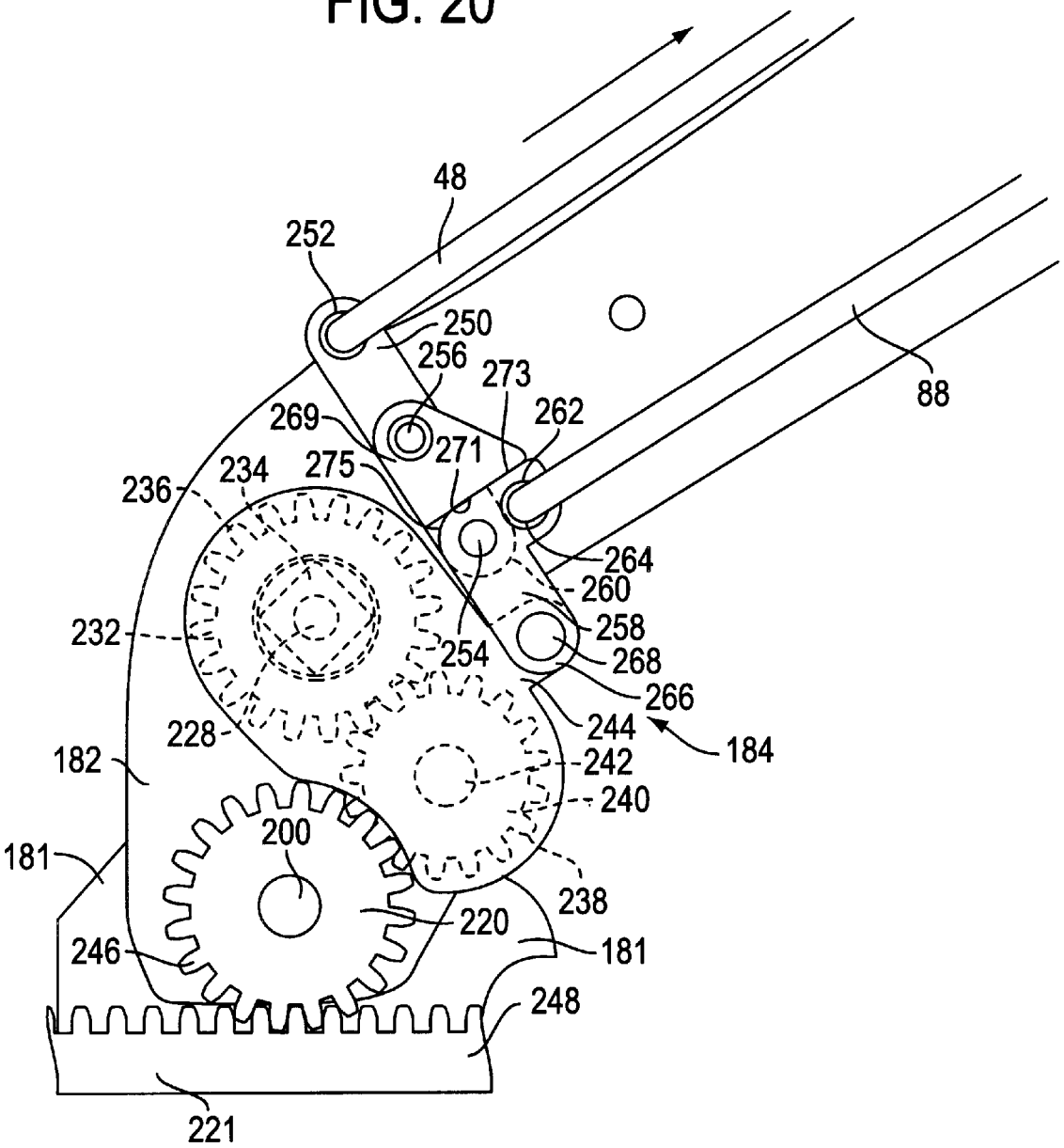
FIG. 20 is a partial plan view of the lower drive assembly with the clutch assembly engaged.

As illustrated in FIGS. 18, 19 and 20, the track rail guide assembly 188 is pivotally attached to the end of the arm structure 198 by a pivot pin 200 and has a generally flattened U-shape bracket 202 of the guide assembly 188 extending beneath the track 204. Rollers 206 are attached by vertical pins 208 at the ends of the legs of bracket 202. Between the legs of bracket 202 is generally rectangular shaped extension 210 that allows a large roller 212 to be attached by a horizontally extending pin 214. The large roller 212 extends axially from pin 214 and rotates orthogonally to rollers 206. The track rail guide assembly 188 provides a means of flexibly but securely holds the lower drive assembly 14 to the track 204 during operation. Rollers 206 ride along the inside surface 218 of a vertically extending wall 216 of the track rail 204, while the large roller 212 runs along a surface 205 of the vehicle body immediately beneath the track 204. Since the guide assembly 188 is pivotally attached to the arm structure 198, the rollers 206 and 212 are capable of following a bend of the track 204 thereby maintaining constant engagement with the surface 216 of track 204 and surface 205 of the vehicle body. Track 204 may thus be contoured to any desired shape while maintaining pinion gear 220 in geared engagement with teeth 248.

Gear drive assembly 186 comprises a power drive gear train, including the pinion gear 220, an input worm gear 222, and a plurality of intermediate gears 226, 232, and 240 for coupling the worm gear 222 with the pinion gear 220.

The worm gear 222 receives its driving input via worm gear 222 from the flexible drive shaft 116 connected with the motor 108. The worm gear 222 is provided with screw gear teeth 122 that mesh with teeth 224 of the first drive gear 226.

First drive gear 226 is a disc structure with teeth 224 extending circumferentially along its outer edge. The first gear 226 rotates about shaft 228, which is affixed at one end to a drive assembly cover plate 230 that is mounted to the arm structure 198. Connecting member 234 is commonly mounted on shaft 228 and connects first drive gear 226 and second drive gear 232 for rotation with one another. Second drive gear 232 is commonly mounted and rotates about shaft 228, and has a diameter approximately half that of first drive gear 226. The teeth 236 of second drive gear 232 are meshed with teeth 238 of the third drive gear 240. The third drive gear 240 is positioned on the same plane as second drive gear 232 and the pinion gear 220. The third drive gear 240 is supported and rotates about shaft 242, which is affixed to clutch assembly mounting plate 244, as will be described in greater detail later.

It can be appreciated that the construction and gearing arrangement of the gear drive assembly 186, particularly the use of worm gear 222 driven by the flexible drive shaft 116, converts a high speed, low torque input to provide a low speed, high torque output to operate the door 10.

Figure 21:
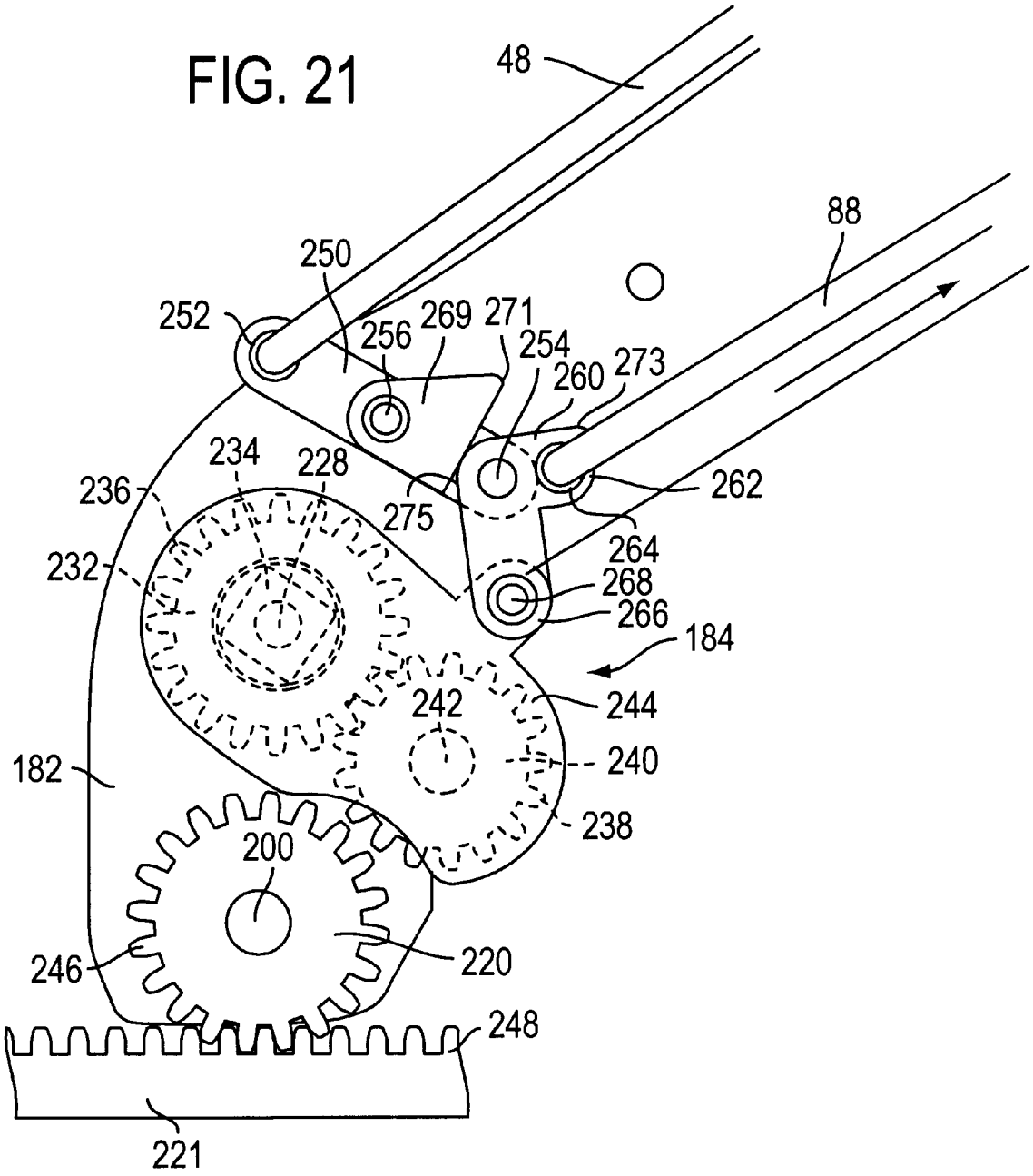
FIG. 21 is an overhead plan view similar to that in FIG. 20, but with the clutch assembly disengaged.

The clutch assembly 184, the operation of which is described in conjunction with FIGS. 20 and 21, incorporates gears 220 and 240 of the drive assembly 186, which are simply disengaged or engaged as part of the clutch operation. In FIGS. 20 and 21, various components, such as gears 222 and 232 have been omitted for sake of clarity of illustration. The clutch assembly 184 also includes the aforementioned mounting plate 244, a pivot link 250 that has a cable connecting opening 252 on one end and a link pin 254 on the other. The pivot link 250 pivots about a centrally disposed pivot pin 256, which is connected at opposite ends between the drive assembly plate 230 and arm structure 198. An L-shaped link 258 is pivotally attached to the pivot link 250 by the link pin 254 at the corner 260 of the legs of the L-shaped link 258. A shorter leg 262 of the L-shaped link 258 has a cable connecting opening 264. The stem 266 of the L-shaped link 258 is pivotally attached to the clutch mounting plate 244 by a pivot pin 268. The clutch mounting plate 244 is pivotally supported or shaft 228 which also serves as the axis of rotation for the first and the second gears 226 and 232, respectively. The clutch assembly 184 further includes a stop member 269 fixed to the pivot link 250 by pin 256. The stop member 269 has an irregular shape that includes a straight edge 271 which is disposed in abutting relation with an adjacent straight edge 273 formed on the shorter leg 262 of the L-shaped link 258 when the clutch assembly is in the engaged position as shown in FIG. 20. The straight edge 273 of the L-shaped link 258 has a curved or arcuate edge 275 about corner 260 in order to create an "over center" condition with the stop member 269 as will be described.

As shown in FIG. 20, the engage cable 48 attaches to the connecting opening 252 of pivot link 250, and the disengage cable 88 attaches to the connecting opening 264 of the link 258. In an engaged condition, the linkage gears 226, 232, and 240 form a driving connection between the worm gear 222 and pinion gear 220. When the disengage cable 88 is pulled by retracting the linear actuator 36 of the brain plate assembly 16 (see FIG. 4), the leg 262 of the L-shaped link 258 is pulled. As a result, the link pin 254 is also pulled, causing the link 250 to pivot in a counterclockwise direction, or disengage sense, about pin 256 in the view shown. During this movement of links 250 and 258, the curved edge 275 of link 258 travels about the straight edge 271 of stop member 269. The force of engagement between edges 275 and 271 increases as the curved edge 275 is forced further into engagement with surface 271, until eventually the "over-center" position is reached. Continued pulling of cable 88 causes the engagement between the edges to go beyond the "over-center" position, and thereafter the force of engagement between the edges 275 and 271 gradually lessens. This "over-center" arrangement enables the clutch assembly to remain virtually locked in the disengaged position (as shown in FIG. 21) even after the tension in cable 88 is relieved.

In moving the links 250 and 258 in the aforementioned manner, the clutch mounting plate 244 is pivoted (in a counterclockwise direction or disengaging sense in the figures) about shaft 228 as a result of movement of the L-shaped link 258 at pivot pin 268. Pivotal movement of the mounting plate 244 in this manner causes the gear 240 to be moved out of mesh with the pinion gear 220. As a result, the clutch assembly 184 is disengaged, and the motor 108 is no longer capable of driving the lower assembly 14 to effect door movement.

The purpose of disengaging clutch assembly 184 is to disconnect the motor 108 from the rack and pinion connection 220, 221 when the door 10 is to operate in manual mode. As a result, the door 10 can be manually moved along track 204 without the load of motor 108 and without inflicting unnecessary wear on the motor 108 and the entire drive system.

Figure 22:
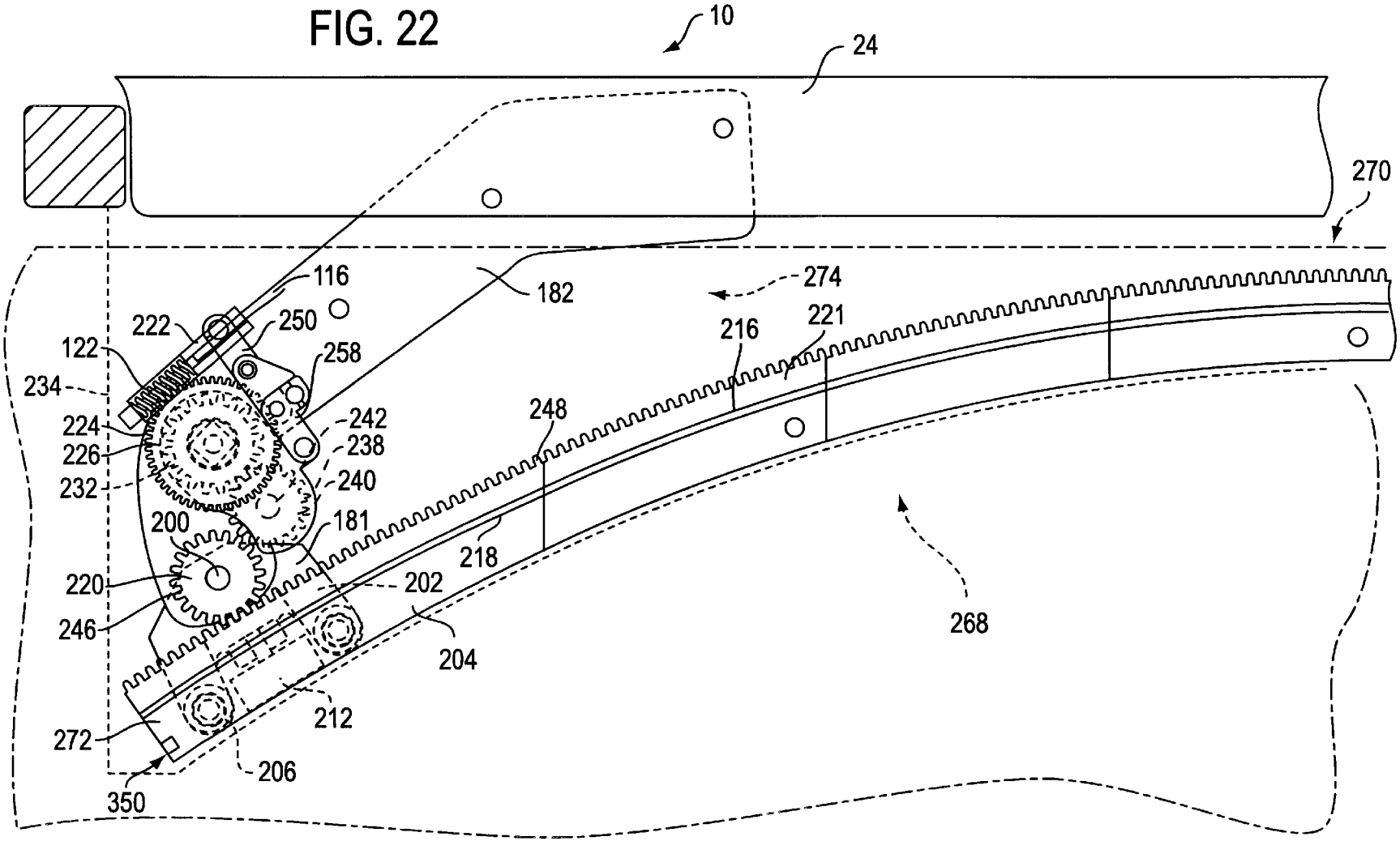
FIG. 22 is a plan view of the door track rail system in mounted relation with a conventional mini-van floor and door sill, and the lower drive assembly at the forward end of the track rail.

FIG. 22 illustrates the general curvature at the front portion of track 204. The track 204 is mounted to the vehicle body 268 in the bottom of a door sill 270, under the vehicle floor 274. The track teeth 248 are the most outboard portion of the track. The track 204 extends from the rear of the door sill 270 linearly forward curving inboard near the front end 272. This shape is a common travel path for sliding doors found on mini-vans.

Figure 23:
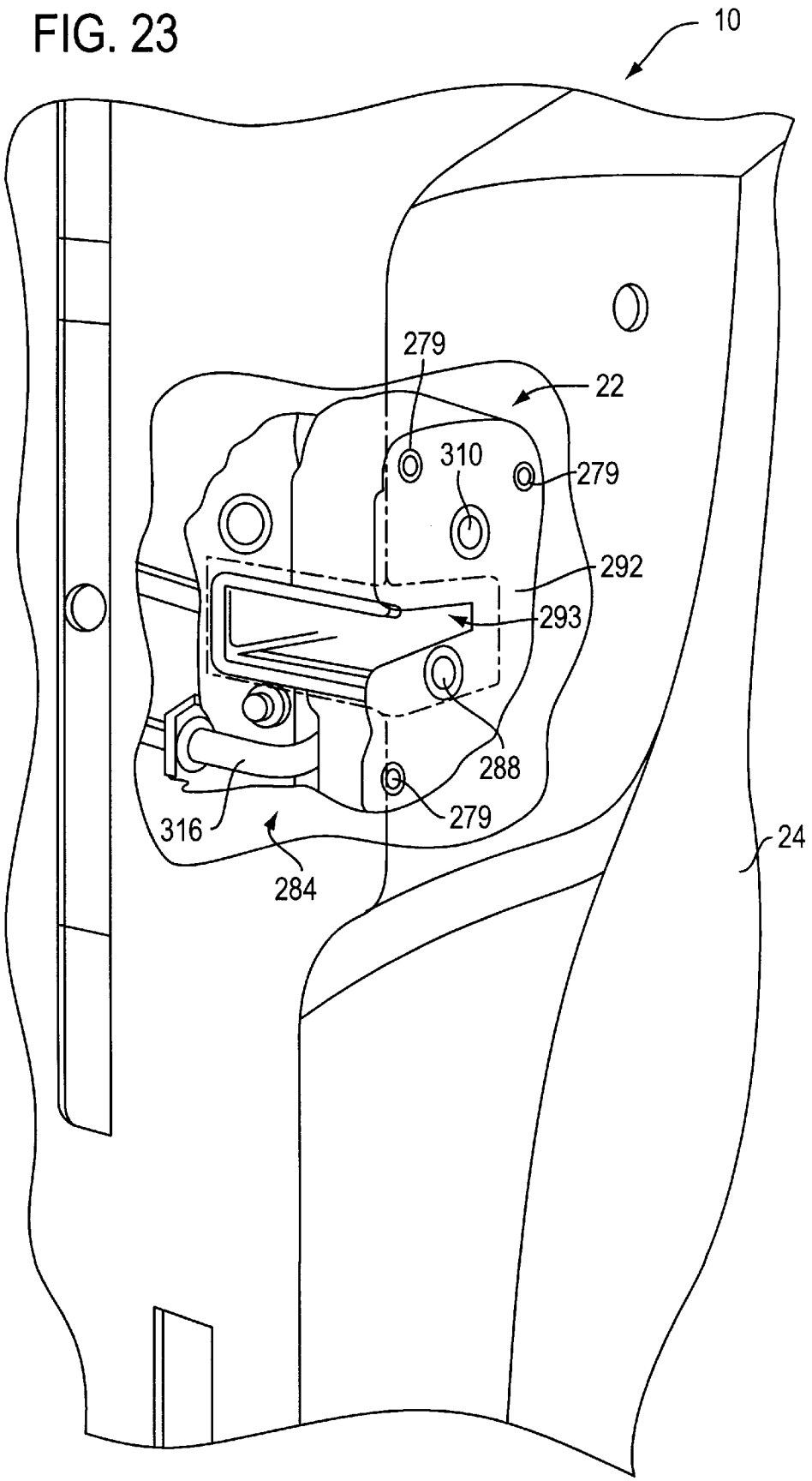
FIG. 23 is an inboard side rear perspective view of the door latch assembly with portions of the door cut away for clarity of illustration.

Shown in FIG. 23 is a perspective view of the latch assembly 22 comprising a latch housing 292 mounted to the vehicle door frame 24 by a plurality of fasteners 279. The housing 292 defines a mouth 293 which receives a door latch striker mounted to a door opening frame in conventional fashion.

Figure 24:
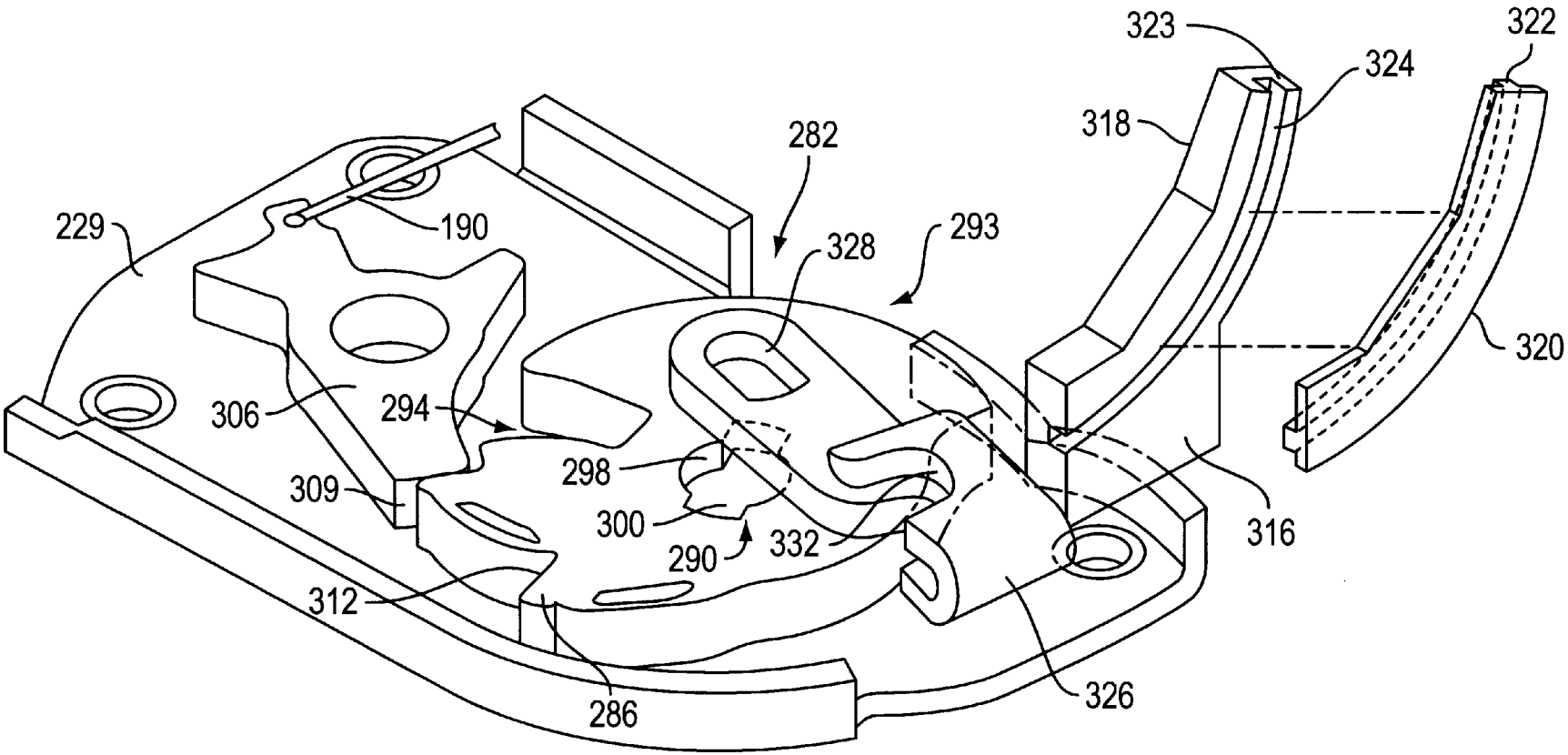
FIG. 24 is a front perspective view of the latch assembly with the cover plate omitted for clarity of illustration.
Figure 25:
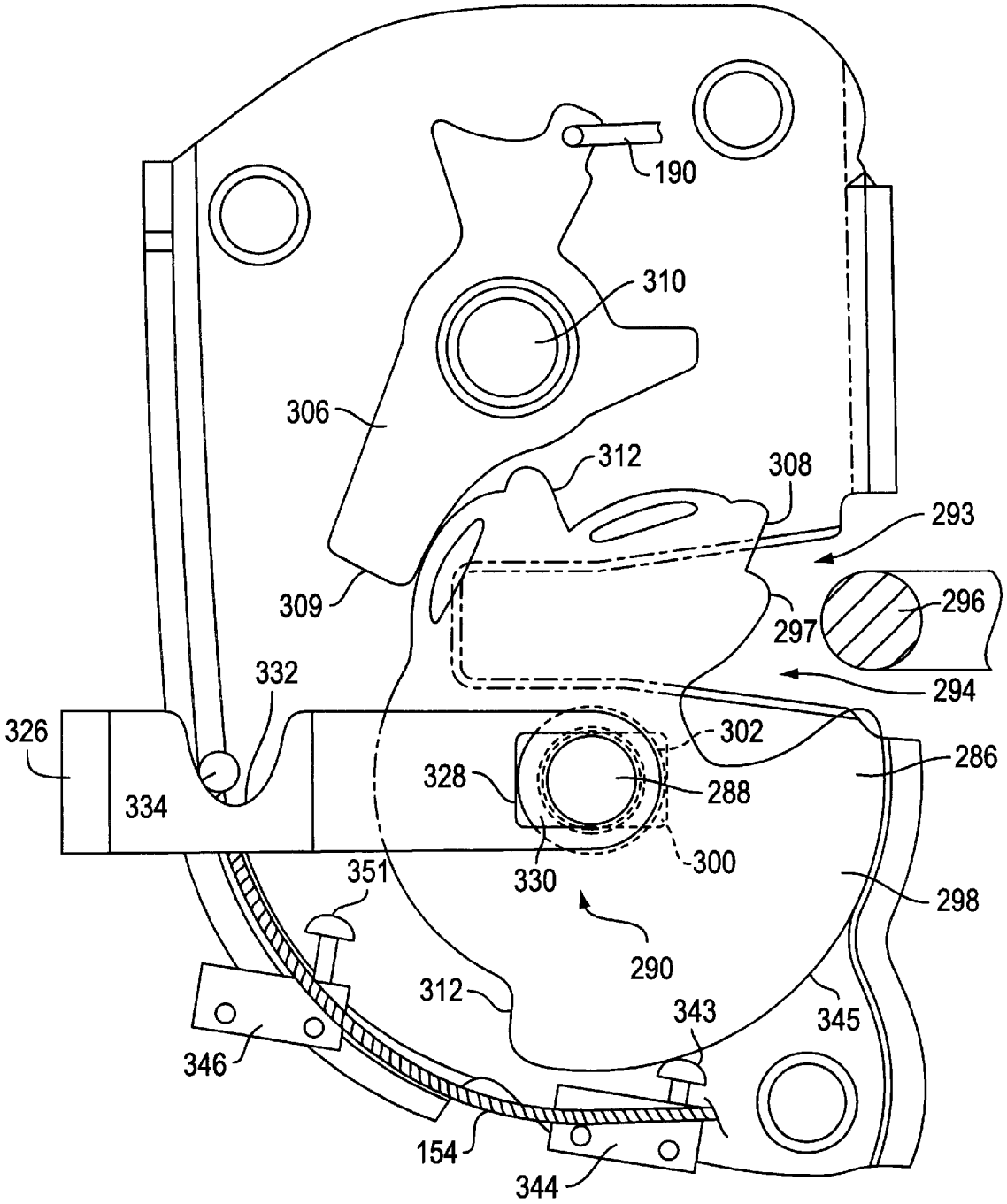
FIG. 25 is a plan view of the latch assembly, with the cover plate omitted, and in the full open position.

In FIG. 24 and 25, a portion of the latch housing 292 has been omitted to better reveal interior components of latch assembly 22. The latch assembly 22 includes a spring biased (spring not shown) pawl or locking arm member 306, and a spring biased (spring not shown) striker retaining member or ratchet 286. The ratchet 286 is mounted for rotation about a pivot pin 288, generally at 290 (see FIG. 25 and is spring biased in the clockwise direction or open condition (as seen in the figures) in conventional fashion. The pivot pin 288 is attached at opposite ends thereof to the latch assembly housing 292. The housing 292 has a cutout that forms the opening 293 for receiving a door striker 296 (see FIGS. 25–28). The ratchet 286 has a slot 294 as is conventional with latches. As is also conventional, the door striker 296 fits into the slot 294 and engages a leading surface portion 297 of the ratchet, causing the ratchet 286 to rotate in a clockwise direction or latching sense against the spring biasing direction, thereby trapping the door striker 294 within the mouth 293.

Figure 26:
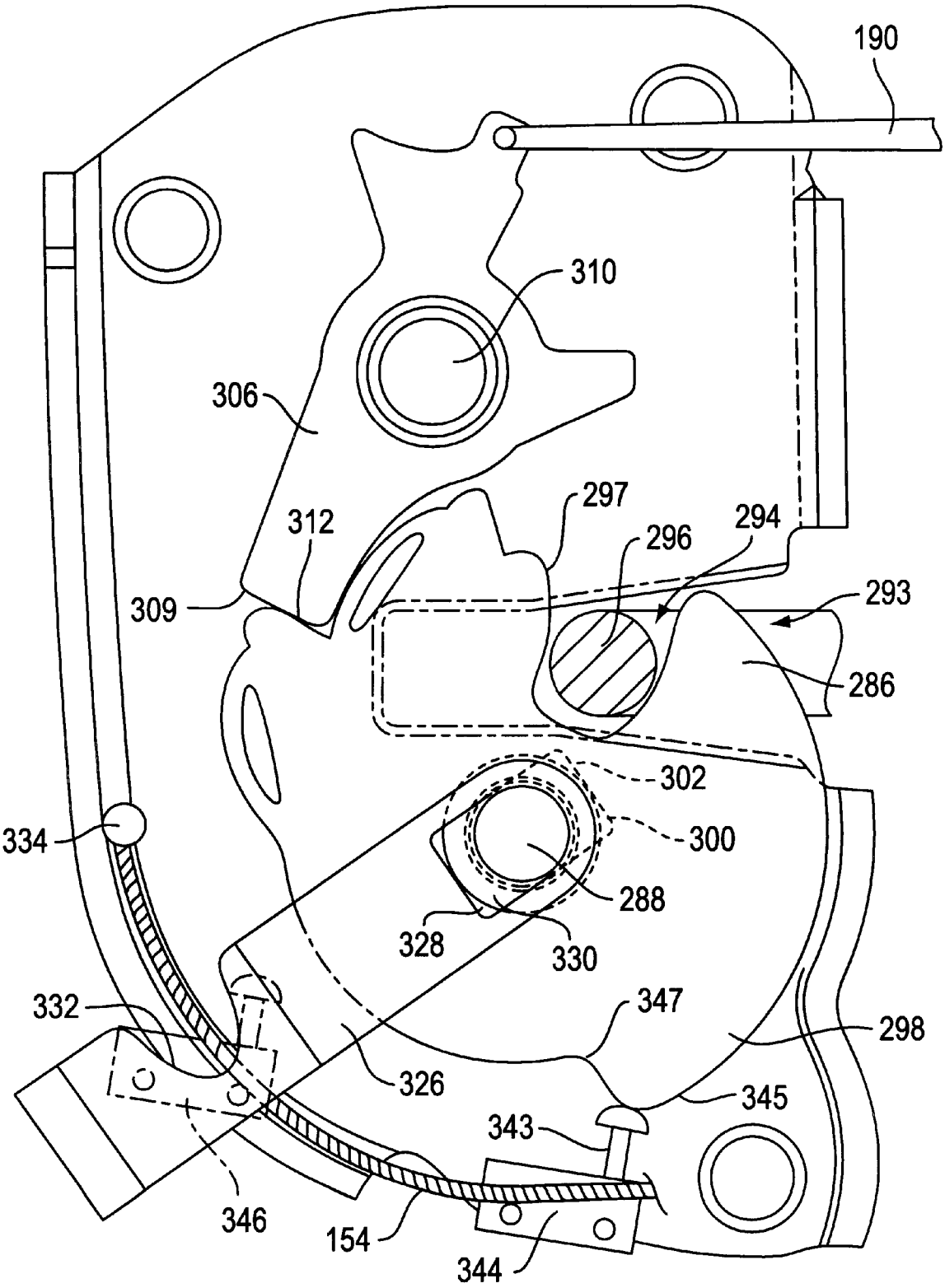
FIG. 26 is a plan view of the latch assembly similar to FIG. 25, but shown in the secondary latching position.
Figure 28:
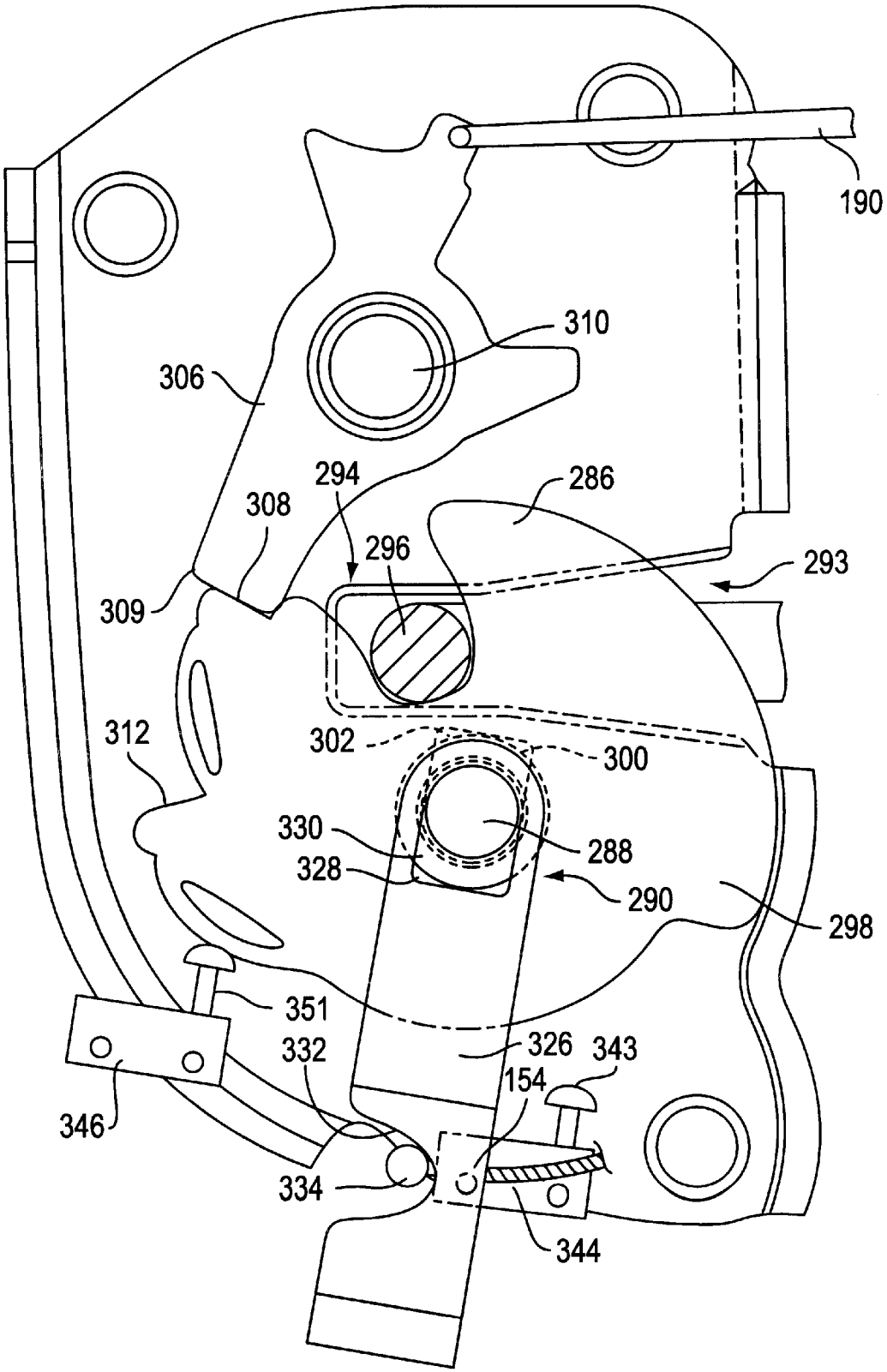
FIG. 28 is a plan view of the latch assembly similar to FIG. 25, but shown in the primary latching position.

The pawl 306 is pivotally mounted at a center portion to the housing 292 by a pin 310. Pawl 306 is conventionally spring biased (spring not shown in Figures) for rotation to engage the ratchet 286. Latch rod 190 is connected to ratchet 186 in a well known manner to rotate pawl 306 to release ratchet 286. The ratchet 286 has a flat edge 308 as shown, which is sized to accept a latching end 309 of locking arm 306. Flat edge 308 acts as an abutment for the pawl 306 in order to lock and hold the ratchet 286 in a primary locking position as shown in FIG. 28. The ratchet 286 also has a second flat edge 312 of the same size and shape as the flat edge 308. This second flat edge 312 also accepts the latching end 309 of the pawl 306. This is the initial latching position for the ratchet 286. During the door closing operation, the lower assembly 14 moves the door 10 until the ratchet 286 engages the door striker 296 and is rotated counterclockwise into the initial latching position as shown in FIG. 26. Movement of the ratchet 286 into the primary position is accomplished by a cinching process, as will be described.

The aforementioned cinch cable 154, described in conjunction with FIG. 6, enters the latch assembly's housing 292 through a cable guide 316 (see FIG. 24). The cable guide 316 is attached to the latch housing 292 or any adjacent portion of the door 10 in any conventional manner. The cable guide 316 is of a two part construction including a first part 318 having an arcuate groove 324 extending therethrough. The groove 324 provides an approximately 90° change in direction for the cinch cable 154. A second part 320 of the cable guide has substantially the same peripheral configuration as the first part, but has an arcuate ridge 322 received into the groove 324. The ridge 322 has a height which extends only partially into groove 324, to close-off the groove, leaving sufficient room for cable 154. The cable guide 316 is preferably made from a hardened plastic, teflon, or resin material, and advantageously functions to properly orient the cinch cable 154 and align it with a cable cinch arm 326. This construction is more cost-effective than conventional pulley assemblies which could also be used to accomplish the same function.

The cinch arm 326 is an elongated member that pivots around a common axis of rotation with ratchet 286. One end of arm 326 has an aperture 328 which enables the arm 326 to be mounted for pivotal movement about pivot pin 288.

Figure 29:
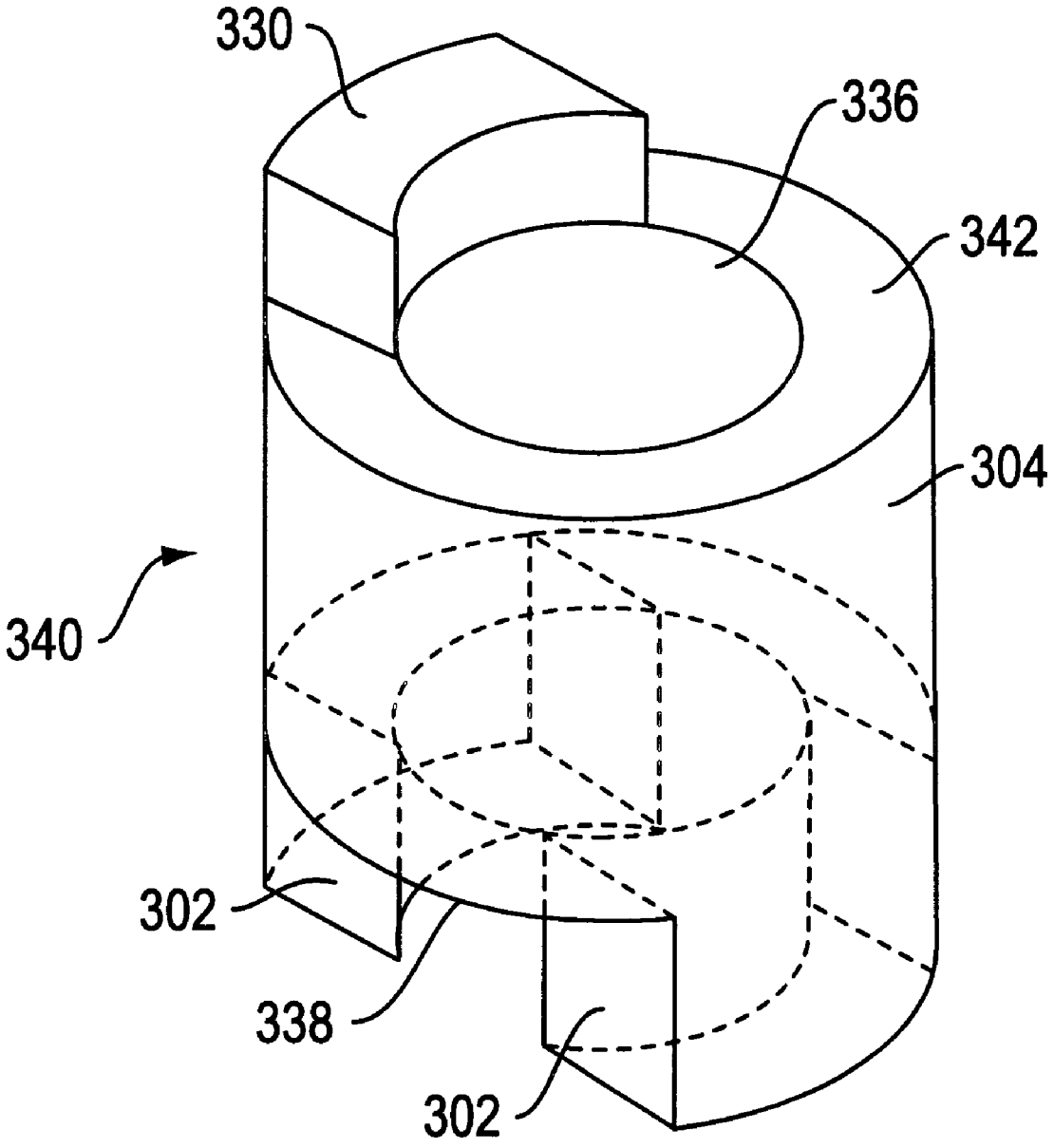
FIG. 29 is a perspective view of a coupler for coupling the ratchet and the cinching arm of the latch assembly.

The ratchet 286 and cable cinch arm 326 are connected together by a coupler member 304, shown in FIG. 29. The coupler 304 enables the ratchet 286 and the cinch arm 326 to be connected at the common pivots, thus allowing the latch assembly 22 to be of a smaller configuration than conventional arrangements in which a cinch arm is connected to the periphery of the ratchet.

The coupler 304 is a cylinder with an aperture 336 extending centrally therethrough. To be connected with coupler 304, as shown in FIG. 24, the generally hook shaped ratchet 286 has an aperture 298 through the central portion thereof. The aperture 298 is generally circular with two rectangular portions 300 extending radially outwardly in opposed relation to each other. Portions 300 are sized and shaped to accept bottom extending elements 302 of the coupler 304. The central portion of the cylindrical coupler 304, generally indicated at 340, acts as a spacer between the ratchet 286 and the cinch arm 326. Extending upwardly from the top flange 342 of coupler 304 is an upper extending element 330 sized to receive the aperture 328 in the cable cinch arm 326. The aperture 336 fits down over a shaft 288, thereby providing a pivotal operating point for the ratchet 286 and cable cinch arm 326 allowing them to rotationally coact within the confines of a relatively smaller latch assembly.

The opposite end of the cinch arm 326 is folded back upon itself forming parallel walls through which the cinch cable 154 extends. A U-shaped notch 332 is provided in each of the walls and in axial alignment with one another. The notch is shaped into the back edge of the parallel walls and accepts and holds a ball end 334 of the cinch cable 154.

FIG. 25 shows the latch assembly 22 in a full open position with the ratchet opening 294 ready to receive the striker 296. The cinch arm 326 extends outwardly and the pawl 306 is biased against the cam surface 345 of the ratchet 286. A first contact switch 344 has an outwardly biased pin member 343 thereof engaged and depressed by the cam surface 345 of the ratchet 286. When depressed, switch 344 sends a signal to microprocessor 20 indicating that latch assembly 22 is unlocked. Also, in FIG. 25, the cinch cable 154 is in a relatively relaxed condition.

FIG. 26 shows the latch assembly 22 in the initial position. The latch assembly 22 is moved into this condition as a result of the lower assembly 14 moving the door 10 towards the closed position. The striker 296, as shown in FIG. 26, has entered the mouth 293 in the housing 292 and has engaged the surface 297 of the ratchet 286, thus causing the ratchet 286 to pivot about the pivot pin 288 until the locking arm 306 is able to move inwardly (counterclockwise) under spring force against a surface 307 of the ratchet 286 after the latching end 309 passes flat edge 312 of the ratchet. When the ratchet 286 is rotated into the initial position, a recessed portion 347 of the cam surface 345 of ratchet 286 releases pin member 343 of the first contact switch 344. The switch 344 sends a signal to the microprocessor 20, indicating the initial position has been reached. Microprocessor 20 responsively then sends appropriate signals to stop the lower assembly 14 from moving the door 10 any further by momentarily stopping motor 108 and disengaging the clutch assembly 184 of the lower assembly 14. The microprocessor 20 responsively energizes cinching clutch 112 to be engaged to initiate the cinching process.

Figure 27:
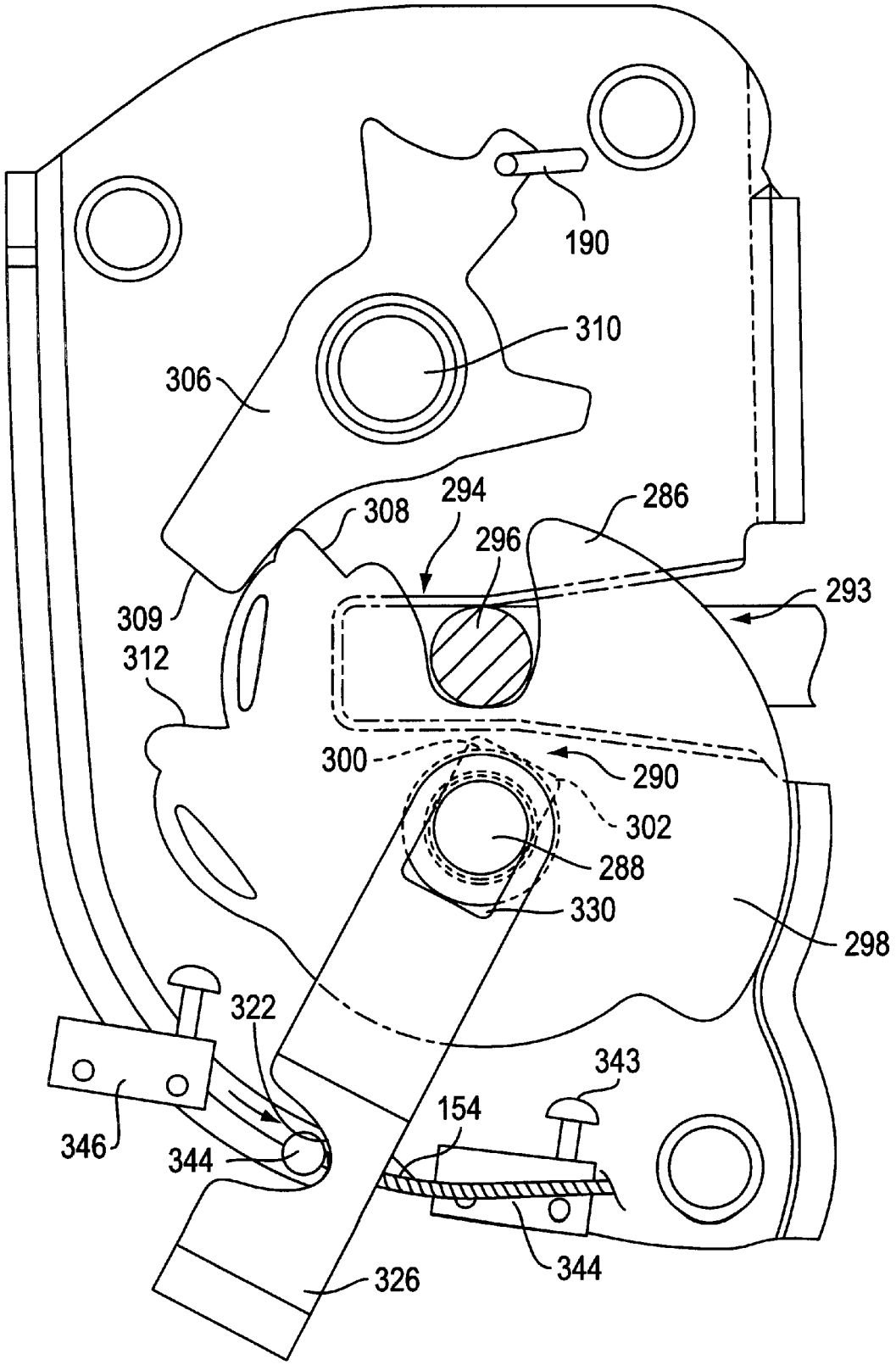
FIG. 27 is a plan view of the latch assembly similar to FIG. 25, but showing the power cinch cable in a cinching mode.

Referring to FIG. 6, after the microprocessor 20 causes the cinching clutch 112 on the motor and gear assembly 18 to engage the cable pulley 114, motor 108 is energized so that the worm gear 118 begins to rotate causing the cinch cable 154 to be pulled or tensioned. Referring to FIG. 27, as the cinch cable 154 is tensioned, the cinch arm 326 is caused to rotate counterclockwise or in a cinching sense and, through the coupler 304, the ratchet 286 is also rotated counterclockwise. As the ratchet 286 is rotated, the striker 296 is maneuvered relatively further into the latch assembly 22, thereby pulling the periphery of the door 10 into sealing engagement with the resilient peripheral door seal strip around the door frame which seals the passenger compartment from the external environment.

In FIG. 28, latch cinching is complete. The cinch arm 326 has rotated the ratchet 286 to the primary position. The flat edge 308 on the ratchet 296 is engaged by the latching end 309 of the pawl 306, thereby locking and holding the latch assembly 22, and therefore the door 10, in a fully closed position. A second contact switch 346 has a pin member 351 which is actuated by being depressed by a protruding portion 349 of the cam surface 345 of ratchet 286, thus sending a signal to the microprocessor 20 indicating that the latch assembly 22 is in the primary position. The microprocessor 20 then responsively signals the motor 108 to stop further cinching, and disengages the cinching clutch 112 so that the pulley 114 then releases the tension from the cinch cable 154.

In order to release the latch assembly 22, the microprocessor 20 sends a signal to the brain plate actuating assembly 16, causing linear actuator 36 to extend. The latch rod 190 is pulled, causing the pawl 306 to rotate against the bias of the lock arm spring in a clockwise direction or a releasing sense away from the ratchet 286 flat edges 308 and 312. As a result, the ratchet spring (not shown) causes the ratchet 286 to rotate in a clockwise direction or releasing sense to the full opened position as shown. Because the cinching clutch 112 connected with the cinch pulley 114 is disengaged at this point, the ratchet urges the arm 326 and cable 154 attached thereto into the stand-by position as shown in FIG. 25.

SYSTEM LOGIC

With the door 10 fully shut and at rest, the lower drive assembly 14 is disengaged, the latch assembly 22 is in the primary position, and the motor and gear assembly 18 is shut off with the cinching clutch 112 disengaged. The door 10 can now be opened by activating an electronic switch either manually or remotely. Upon receiving a signal to open the door 10, the microprocessor 20 releases the latch assembly 22 and engages the lower drive assembly 14. More specifically, microprocessor 20 sends a signal to the linear actuator 36 of the brain plate actuating assembly 16, which extends actuator rod 52. The bumper 62 contacts rod clamp 42, thus moving the rod clamp and the latch rod 190 connected thereto to the left in the figures. This unlatches the latch assembly 22, and causes the engage cable 48 to be tensioned to ensure that clutch assembly 184 of lower drive assembly 14 engages the drive gears to be driven by motor 108.

The motor 108 begins to rotate the flexible drive shaft 116, slowly building up speed by increasing the effective voltage to avoid in-rush current in the motor. The drive shaft 116 drives the gears of the lower drive assembly 14. As pinion gear 220 of the lower drive assembly 14 turns, it drives the door 10 along the track system 216, drawing the door open. As the door 10 reaches the end of the track system 216 it hits a travel switch 350 (see FIG. 22), whereby the microprocessor 20 responsively stops motor 108 to stop travel of the door 10. The lower drive assembly 14 remains engage, now holding the door 10 in the full open position.

In manual mode of door opening operation, the inner or outer door handle (not shown) is engaged and moved, thus causing the plate 95 of brain plate assembly 16 to pivot in a counterclockwise direction or unlatching sense. This action tensions disengage cable 88 to disengage clutch assembly 184 of lower assembly 14 and moves latch rod 190 to unlock door latch assembly 22. The door is then manually moved to the opened position. When the door reaches the full opened positioned, a contact trip switch 352 is engaged, sending a signal to microprocessor 20. The microprocessor 20 then sends a signal to the actuator 36, causing extension rod 52 to extend and the engage cable 48 to engage the lower assembly clutch 184 to maintain the door 10 in the fully opened position.

To close the door 10, the microprocessor 20 extends the extension rod 52 of the brain plate actuating assembly 16, pulling the engage cable 48, engaging the lower drive assembly 14. The microprocessor 20 then slowly starts the motor 108, which draws the door 10 closed until the initial position of the latch assembly 22 is reached as detected by latch switch 344. The microprocessor 20 now momentarily stops, and then instantaneously reverses the motor 108 in order to prevent friction lock-up between the clutch gears of lower assembly 14, before such gears are disengaged. At substantially the same time, the microprocessor 20 sends a signal to the linear actuator 36 to disengage the clutch gears of the lower drive assembly 14. With the lower drive assembly 14 disengaged, the microprocessor 20 sends a signal to the cinching clutch 112 to engage the cable pulley 114 and energizes the motor 108 to continue rotation in the aforementioned reverse direction to cause the gears in assembly 18 to rotate the pulley 114 in a direction that will pull on the cinch cable 154. As a result, the arm 326 and ratchet 286 of the latch assembly 22 will cinch the latch into the primary latching position. Once the latch assembly 22 is in the primary position, the latch switch 346 sends a signal to the microprocessor 22, which releases the tension on the cable pulley 114 and shuts the motor 108 off.

To close the door 10 in manual mode, the inside or outside door handle is lifted so that the disengage cable 88 is tensioned to release the clutch assembly 184 of the lower arm assembly 14. The door 10 can then be manually moved to the closed position. The momentum imparted to the door in normal operation is sufficient to cause the latching ratchet 286 to hit the door striker and rotate the ratchet into the primary position.

Additional advantages and modifications will readily occur to those skilled in the art. Therefore, the invention is not limited to the specific details and representative embodiments shown and described herein. Accordingly, various modifications to the embodiments may be made without departing from the spirit or scope of the invention as described by the appended claims.

What we claim is:

1. A power sliding door for a motor vehicle comprising:

a door structure mounted on a track for association with said motor vehicle, said door structure being movable along said track between opened and closed positions;

a power drive assembly connected with said door and capable of being driven to move the door along said track between said opened and closed positions;

said power drive assembly including a clutch assembly for coupling said power drive assembly to said track;

a latch assembly mounted on said door and movable between latched and unlatched positions;

a single motor mounted on said door structure and operatively connected with both said power drive assembly for driving said power drive assembly to enable said power drive assembly to move said door along said track between said opened and closed positions and said latch assembly to assist movement of said latch assembly to said latched position after said power drive assembly moves said door to said closed position;

a controller operably connected to an actuator which disengages said clutch assembly and thereby decouple said power drive assembly from said track after said power drive assembly has moved said door to an initial latching position of said latch assembly;

wherein said clutch assembly of said power drive assembly comprises a power drive gear train, and wherein said power drive gear train is disengagable to decouple said power drive assembly from said track, wherein said motor reverses direction after said power drive assembly has moved said door to said initial latching position to facilitate disengagement of said power drive gear train.

2. The power sliding door of claim 1, wherein said motor is selectively engageable with said power drive assembly and said latch assembly, further comprising a latch assembly clutch mechanism and a power drive clutch mechanism, said controller providing control signals to said power drive clutch mechanism to selectively engage, said motor with said power drive assembly and to said latch assembly clutch mechanism to disengage said motor from said latch assembly when said motor drives said power drive assembly.

3. The power sliding door of claim 1, wherein said motor is selectively engageable with said power drive assembly and said latch assembly, further comprising a latch assembly clutch mechanism and a power drive clutch mechanism, said controller providing control signals to said latch assembly clutch mechanism to selectively engage said motor with said latch assembly and to said power drive clutch mechanism to disengage said motor from said power drive assembly when said motor assists movement of said latch assembly to said latched position.

4. The power sliding door of claim 1, further comprising a clutch assembly, said clutch assembly being engaged to couple said motor with said latch assembly and being disengaged to decouple said motor from said latch assembly, said controller controlling the engagement and. disengagement of said clutch assembly.

5. The power sliding door of claim 1, further comprising a flexible drive shaft connecting said motor with said power drive assembly.

6. The power sliding door of claim 5, wherein said motor comprises a rigid motor shaft, said rigid motor shaft being capable of rotatably driving said flexible drive shaft.

7. The power sliding door of claim 5, wherein said power drive assembly includes a clutch coupled to said flexible drive shaft for engaging said flexible drive shaft to said power drive assembly or disengaging said flexible drive shaft from said power drive assembly.

8. The power sliding door of claim 1, further comprising:

a latch assembly gear train coupled to said motor;

a clutch coupled to said latch assembly gear train; and a cable pulley coupled to said clutch, said cable pulley including a cable having an end coupled to said latch assembly;

said clutch being capable of engaging said latch assembly gear train to said cable pulley or disengaging said latch assembly gear train from said cable pulley.

9. The power sliding door of claim 8, wherein said motor comprises a rigid motor shaft forming a worm gear having teeth which are meshed with teeth of said latch assembly gear train.

10. The power sliding door of claim 8, wherein said power drive assembly further comprising a flexible drive shaft connecting said motor with said power drive assembly and a clutch coupled to said flexible drive shaft for engaging said flexible drive shaft to said power drive assembly or disengaging said flexible drive shaft from said power drive assembly.

11. The power sliding door of claim 10, wherein said controller provides control signals to said clutch coupled to said latch assembly gear train and said clutch coupled to said flexible drive shaft to enable said clutch coupled to said latch assembly gear train to engage said latch assembly gear train to said cable pulley while said power drive assembly is disengaged from said flexible drive shaft by said clutch coupled to said flexible drive shaft.

12. The power sliding door of claim 11, wherein said controller controls said clutch coupled to said latch assembly gear train and said clutch coupled to said flexible draft shaft to enable said clutch coupled to said flexible drive shaft to engage said flexible drive shaft with said power drive assembly while said latch assembly gear train is disengaged from said cable pulley by said clutch coupled to said latch assembly gear train.

13. The power sliding door of claim 10, wherein said controller provides control signals to said clutch coupled to said latch assembly gear train and said clutch coupled to said flexible drive shaft to enable said clutch coupled to said flexible drive shaft to engage said flexible drive shaft with power drive assembly while said latch assembly gear train is disengaged from said cable pulley by said clutch coupled to said latch assembly gear train.

14. The power sliding door of claim 1, further comprising:

at least one sensor for measuring speed and direction of rotation of said motor when said motor drives said power assembly; and a detector for determining when said speed of said motor is less than a predetermined threshold;

said motor reversing the direction of rotation of said motor when said detector determines that said speed of said motor is less than said predetermined threshold.

15. The power sliding door of claim 14, further comprising a tape switch mounted on said door for detecting an obstacle to movement of said door;

wherein said motor reverses said direction of rotation of said motor when said tape switch detects said obstacle.

16. The power sliding door of claim 14, wherein said at least one sensor includes a Hall effect sensor.

17. The power sliding door of claim 1, wherein said controller provides a control signal having an effective voltage level to said motor;

wherein said signal slowly increases to said effective voltage level when initiating the opening or closing of said door.

18. The power sliding door of claim 1, further comprising a cable driving pulley and a cable associated therewith, and a clutch assembly coupling said cable driving pulley with said motor, said cable driving pulley being drivable by said motor when said clutch assembly is engaged, said cable being connected with said latch assembly and being movable to facilitate movement of said latch assembly from said initial latching position to said latched position, and wherein said clutch assembly is engaged after said power drive assembly has moved said door to said initial latching position to enable said cable driving pulley to move said cable for facilitating movement of said latch assembly from said initial latching position to said latched position.

* * * * *